US008721170B2

(12) United States Patent
Manaka et al.

(10) Patent No.: US 8,721,170 B2
(45) Date of Patent: May 13, 2014

(54) STEPPING MOTOR CONTROL CIRCUIT, MOVEMENT, AND ANALOGUE ELECTRONIC TIMEPIECE

(71) Applicant: Seiko Instruments Inc., Chiba (JP)

(72) Inventors: Saburo Manaka, Chiba (JP); Kenji Ogasawara, Chiba (JP); Kazumi Sakumoto, Chiba (JP); Keishi Honmura, Chiba (JP); Kosuke Yamamoto, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 13/713,060

(22) Filed: Dec. 13, 2012

(65) Prior Publication Data

US 2013/0170328 A1 Jul. 4, 2013

(30) Foreign Application Priority Data

Dec. 19, 2011 (JP) ..... 2011-277569
Sep. 7, 2012 (JP) ..... 2012-197536

(51) Int. Cl.
*G04B 18/00* (2006.01)

(52) U.S. Cl.
USPC ..... 368/200

(58) Field of Classification Search
USPC ..... 368/200, 76, 80–81, 202, 204, 368/217–219, 155–157, 160; 318/696
See application file for complete search history.

(56) References Cited

U.S. PATENT DOCUMENTS

| | | | | |
|---|---|---|---|---|
| 6,021,097 | A * | 2/2000 | Kanno et al. | 368/64 |
| 6,163,126 | A | 12/2000 | Kojima et al. | 318/685 |
| 6,466,519 | B1 * | 10/2002 | Nakamura et al. | 368/64 |
| 7,113,452 | B2 * | 9/2006 | Fujita et al. | 368/66 |
| 7,663,978 | B2 * | 2/2010 | Kawaguchi et al. | 368/66 |
| 2008/0089183 | A1 | 4/2008 | Manaka et al. | 368/202 |
| 2010/0149924 | A1 | 6/2010 | Ogasawara et al. | 368/80 |
| 2010/0220556 | A1 | 9/2010 | Yamamoto et al. | 368/80 |

* cited by examiner

*Primary Examiner* — Edwin A. Leon
(74) *Attorney, Agent, or Firm* — Adams & Wilks

(57) ABSTRACT

A rotation detection unit configured to detect the condition of rotation of a stepping motor on the basis of an induced signal generated in a drive coil of the stepping motor in a detection period in which the condition of rotation of the stepping motor is detected and a control unit configured to rotationally drive the stepping motor by supplying a drive signal to the drive coil of the stepping motor within the driving period in which the stepping motor is rotationally driven are provided. The driving period and part of the detection period are configured to overlap with each other in a first time interval, and the control unit stops supply of the drive signal to the drive coil of the stepping motor in the first time interval.

20 Claims, 12 Drawing Sheets

FIG. 3

| STATE | BEHAVIOR OF ROTATION | VRs OUTPUT TIMING | T0 | T1 | T2 | T3 | PULSE ACTION |
|---|---|---|---|---|---|---|---|
| EXCESSIVE ENERGY DRIVING ROTATION WITH LARGE RESERVE CAPACITY | | | 1 | 1/0 | 1/0 | 1/0 | PULSE DOWN |
| NORMAL DRIVING ROTATION WITH LARGE RESERVE CAPACITY | | | 1 | 1/0 | 1/0 | 1/0 | PULSE DOWN |
| SMALL LOAD INCREMENT ROTATION WITH SMALL RESERVE CAPACITY | | | 0 | 1 | 1 | 1/0 | HOLD PULSE |
| LARGE LOAD INCREMENT ROTATION WITH LEAST RESERVE CAPACITY | | | 0 | 1 | 0 | 1 | PULSE UP |
| EXTREMELY LARGE LOAD INCREMENT NON-ROTATION | | | 0 | 1/0 | 0 | 0 | PULSE UP + P2 |

FIG. 4

| DETECTION OF ROTATION | | | | | RANK OPERATION | | |
|---|---|---|---|---|---|---|---|
| T0 | T1 | T2 | T3 | DETERMINATION | JUDGMENT | P1 | P2 |
| 1 | 1/0 | 1/0 | 1/0 | EXTREME/NORMAL ROTATION WITH LARGE RESERVE DRIVING CAPACITY | DEGRADE | -1 RANK | NO |
| 0 | 1 | 1 | 1/0 | SMALL LOAD INCREMENT ROTATION WITH SMALL RESERVE DRIVING CAPACITY | HOLD | ±0 RANK | NO |
| 0 | 1 | 0 | 1 | LARGE LOAD INCREMENT ROTATION WITH LEAST RESERVE DRIVING CAPACITY | UPGRADE | +1 RANK | NO |
| 0 | 1 | 0 | 0 | LARGE LOAD INCREMENT NON-ROTATION DRIVING | P2+UPGRADE | +1 RANK | YES |
| 0 | 0 | 1/0 | 1/0 | EXTREMELY LARGE LOAD INCREMENT NON-ROTATION DRIVING | P2+UPGRADE | +1 RANK | YES |

FIG. 10

| DETECTION OF ROTATION | | | | | RANK OPERATION | | | |
|---|---|---|---|---|---|---|---|---|
| T0 | T1 | T2 | T3 | DETERMINATION | JUDGMENT | DOWN COUNT | P1 | P2 |
| 1 | 1/0 | 1/0 | 1/0 | ROTATION WITH EXTREMELY LARGE RESERVE DRIVING CAPACITY | DEGRADE | ONE TIME | -2 RANKS | NO |
| 0 | 0 | 1 | 1/0 | NORMAL ROTATION WITH LARGE RESERVE DRIVING CAPACITY | DEGRADE | 80 TIMES | -1 RANK | NO |
| 0 | 1 | 1 | 1/0 | SMALL LOAD INCREMENT ROTATION WITH SMALL RESERVE DRIVING CAPACITY | HOLD | — | ± 0 RANK | NO |
| 0 | 1/0 | 0 | 1 | LARGE LOAD INCREMENT ROTATION WITH LEAST RESERVE DRIVING CAPACITY | UPGRADE | — | +1 RANK | NO |
| 0 | 1/0 | 0 | 0 | EXTREMELY LARGE LOAD INCREMENT NON-ROTATION DRIVING | P2+UPGRADE | — | +1 RANK | YES |

STEPPING MOTOR CONTROL CIRCUIT, MOVEMENT, AND ANALOGUE ELECTRONIC TIMEPIECE

BACKGROUND OF THE INVENTION

1. Field of the Invention

The present invention relates to a stepping motor control circuit, a movement having the stepping motor control circuit, and an analogue electronic timepiece using the movement.

2. Description of the Related Art

In the related art, a stepping motor including a stator having a rotor housing through hole and a plurality of positioning portions for determining a stable still position of a rotor, the rotor disposed in the rotor housing through hole, and a driving coil wound around the stator is used in analogue electronic timepieces or the like. The stepping motor described above is configured to perform detection of rotation in order to achieve further reliable rotation. (See Japanese Patent No. 3757421 and International Publication No. 2005/119377, for example).

In an invention disclosed in Japanese Patent No. 3757421, a stepping motor driving coil and a rotation detecting coil are wound one on top of another on a stator in order to detect a rotation of a stepping motor, and the rotational driving of the stepping motor is performed by the driving coil, and detection of rotation is performed by the rotation detecting coil.

Since the driving coil and the rotation detecting coil are used, the detection of rotation may be performed by the rotation detecting coil in parallel with the driving even within a period when the stepping motor is driven by a drive pulse, and hence detection of rotation with high degree of accuracy is possible.

However, since the rotation detecting coil specific for the detection of rotation, which is different from the driving coil, is used for the detection of rotation, there is a problem that the stepping motor is complicated in configuration and increased in size.

In contrast, International Publication No. 2005/119377 discloses an invention in which a stepping motor is rotationally driven by using main drive pulses P1 in a plurality of energy ranks. A rotor is rotated by a main drive pulse P11, then if an induced signal VRs generated by free vibrations of the rotor is reduced to a level lower than a predetermined reference threshold voltage Vcomp, the stepping motor is driven by a corrected drive pulse P2 having energy larger than the respective main drive pulses P1, and the main drive pulse P1 used for the next drive is ranked up to a main drive pulse P12 having energy larger than the main drive pulse P11.

When the rotor is rotated by the main drive pulse P12, the induced signal VRs exceeding the reference threshold voltage Vcomp is detected, and when the time-of-day when the induced signal VRs is detected is earlier than a reference time-of-day, it is determined that the energy is too large, and the main drive pulse P12 is ranked down to the main drive pulse P11. Accordingly, the rotor is rotated at the main drive pulse P1 in accordance with a load during the drive, whereby a current consumption is reduced.

In an invention disclosed in International Publication No. 2005/119377, since rotary driving and detection of rotation of the stepping motor are performed by using a driving coil, complication of configuration as the invention described in Japanese Patent No. 3757421 is avoided.

However, according to the invention in International Publication No. 2005/119377, the rotation is detected during a detection period DT provided after the completion of driving by the main drive pulse P1.

Therefore, in a case of the main drive pulse P1 having large energy, the induced signal VRs exceeding the reference threshold voltage Vcomp is generated within a driving period P of the main drive pulse P1, and only induced signals VRs which do not exceed the reference threshold voltage Vcomp are generated during the detection period DT.

Therefore, there is a problem of erroneous determination such that the rotor is not rotated even it is rotated may occur. When it is determined erroneously that the rotor is not rotated, the rotor is rotationally driven by using a corrected drive pulse P2 having energy larger than the main drive pulse P1. Therefore, there are fears of large power consumption and an extremely shortened battery life.

JP-A-2010-145106 discloses an invention in which a pulse down counter circuit configured to output a pulse down control signal for performing pulse-down control of a main drive pulse P1 on a first cycle or a second cycle longer than the first cycle is provided, a rotation detection period is divided into a first detection time interval immediately after the driving by a main drive pulse, a second detection time interval coming after the first detection time interval, and a third detection time interval coming after the second detection time interval, and when a rotation detection unit detects an induced signal VRs exceeding a reference threshold voltage Vcomp, a pulse down cycle of the pulse down counter circuit is changed to the second cycle to allow earlier pulse down.

However, since two counters, one having a short cycle and the other having a long cycle, are provided in the invention disclosed in JP-A-2010-145106, a large space is occupied if a stepping motor control circuit is configured as an integrated circuit (IC), and hence there arises a problem of difficulty in reduction in size.

JP-A-2010-220461 discloses an invention in which a detection time interval in which a condition of rotation is detected is divided into a plurality of time intervals, and when performing pulse down, a detection value from a time interval T2 is used for control, and considering variations caused by mass production and the safety degree of operation, pulse control is performed aiming that detection of an induced signal VRs exceeding a reference threshold voltage Vcomp is achieved in a latter half of a time interval T2 (time interval T2B) indicating that drive allowance is reduced.

In the configuration in JP-A-2010-220461, the pulse down is performed when a state in which the induced signal VRs exceeding a predetermined value is detected in the time interval T2B (a state in which the drive allowance is small) occurs continuously by a predetermined first number of times and, when a condition of rotation having a large drive allowance occurs even through the condition of rotation in which the drive allowance is small does not occur continuously by the predetermined first number of times, the pulse down is also performed before the occurrence of the state described above continuously by the first number of times.

Accordingly, a reduction of power consumption is enabled with stabilized operation by performing the pulse down in a shorter time when the drive allowance is large, and performing the pulse down in a longer time when the operation is stabilized even though the drive allowance is small.

However, since the pulse down is performed only when the state of having a sufficient energy allowance results continuously by the predetermined number of times, there is a problem of waste of energy until the pulse down is performed.

The invention disclosed in JP-A-2010-220461 is also configured in such a manner that when the induced signal VRs exceeding a reference threshold voltage Vcomp is generated in a time interval T1, the rank is maintained even when the induced signal VRs exceeding the reference threshold voltage Vcomp is generated in any one of a front half (time interval T2A) and the latter half (time interval T2B) of the time interval T2. When the induced signal VRs exceeding the reference threshold voltage Vcomp is detected in the time interval T2A, the pulse down is not performed even though sufficient drive allowance exists and hence the state allows pulse down, so that there is a problem of wasted power consumption.

SUMMARY OF THE INVENTION

It is an aspect of the present application to enable detection of rotation with high degree of accuracy in a simple configuration even when a drive pulse having large energy is used for driving.

It is another aspect of the present application to achieve further low power consumption by performing pulse down as quickly as possible in a state of having a large drive allowance, and to achieve further low power consumption by performing pulse down to a drive pulse having energy as small as possible but enough to rotate.

According to the application, there is provided a stepping motor control circuit including: a rotation detection unit configured to detect the condition of rotation of a stepping motor on the basis of an induced signal generated in a drive coil of the stepping motor in a detection period in which the condition of rotation of the stepping motor is detected; and a control unit configured to rotationally drive the stepping motor by supplying a drive signal to the drive coil of the stepping motor in a driving period in which the stepping motor is rotationally driven, wherein the drive period and part of the detection period are configured to overlap in a first time interval, and the control unit stops supply of the drive signal to the drive coil of the stepping motor in the first time interval within the driving period.

According to the application, there is provided a movement including the stepping motor control circuit.

According to the application, there is provided an analogue electronic timepiece including the movement.

According to the stepping motor control circuit of the application, detection of rotation with high degree of accuracy is enabled in a simple configuration even when being driven by a drive pulse having large energy.

According to the movement of the application, an analogue electronic timepiece capable of detection of rotation with high degree of accuracy with a simple configuration even when being driven by a drive pulse having large energy may be constructed.

According to the analogue electronic timepiece of the application, detection of rotation with high degree of accuracy is enabled in a simple configuration even when being driven by a drive pulse having large energy, so that an accurate movement of hands is achieved.

BRIEF DESCRIPTION OF THE DRAWINGS

FIG. 3 is a timing chart common to the stepping motor control circuits and the analogue electronic timepieces according to first and second embodiments of the invention;

FIG. 4 is a determination chart common to the stepping motor control circuits and the analogue electronic timepieces according to the first to the third embodiments of the invention;

FIG. 10 is a determination chart common to fourth and fifth embodiments of the invention;

MODE FOR CARRYING OUT THE INVENTION

Figure 1:
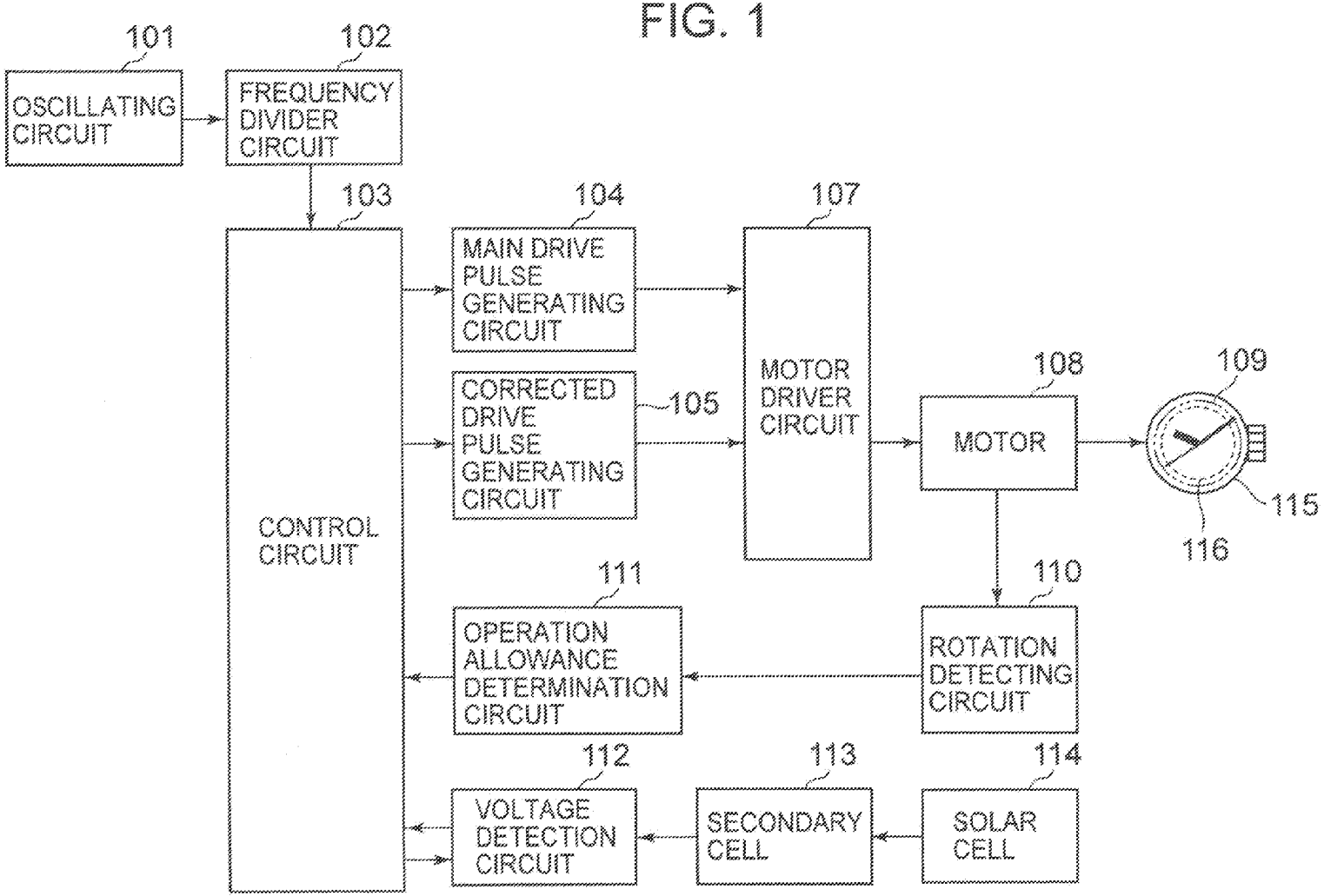
FIG. 1 is a block diagram common to analogue electronic timepieces in which stepping motor control circuits according to respective embodiments of the invention are used.

FIG. 1 is a block diagram common to stepping motor control circuits, movements provided with the corresponding stepping motor control circuits, and analogue electronic timepieces provided with the corresponding movements according to the respective embodiments of the invention, illustrating an example of an analogue electronic timepiece.

In FIG. 1, the analogue electronic timepiece includes an oscillating circuit 101 configured to generate a signal of a predetermined frequency, a frequency divider circuit 102 configured to divide frequency of the signal generated by the oscillating circuit 101 and generate a time signal as a reference of time counting, and a control circuit 103 configured to perform various types of control such as control of a time counting action of the time signal or respective electronic circuit elements which constitute the analogue electronic timepiece or pulse control that changes and controls a drive pulse.

The analogue electronic timepiece includes a main drive pulse generating circuit 104 configured to select and output a main drive pulse P1 corresponding to a main drive pulse control signal from the control circuit 103 from among a plurality of types of main drive pulses P1 having energies different from each other, and a corrected drive pulse generating circuit 105 configured to output a corrected drive pulse P2 having energy larger than that of the respective main drive pulses P1 in response to a corrected drive pulse control signal from the control circuit 103.

The analogue electronic timepiece also includes a motor driver circuit 107 configured to rotationally drive a stepping motor 108 on the basis of the main drive pulse P1 from the main drive pulse generating circuit 104 and the corrected drive pulse P2 from the corrected drive pulse generating circuit 105.

The analogue electronic timepiece further includes the stepping motor 108 configured to be rotationally driven by the motor driver circuit 107, an analogue display unit 109 having time-of-day hands for displaying time-of-day, a calendar display portion and the like rotationally driven by the stepping motor 108, a rotation detecting circuit 110 configured to detect an induced signal VRs generated by the stepping motor 108 in a predetermined detection period DT and output a detection signal Vs indicating the condition of rotation, and an operation allowance determination circuit 111 configured to determine the degree of energy allowance of the drive pulse that rotationally drives the stepping motor 108 on the basis of the induced signal VRs detected by the rotation detecting circuit 110.

The analogue electronic timepiece also includes a secondary cell 113 as a power source configured to supply power to respective electronic circuit elements of the analogue electronic timepiece including the stepping motor 108, a solar cell 114 configured to charge the secondary cell 113, and a voltage detection circuit 112 configured to detect a voltage of the secondary cell 113. The secondary cell 113 functions as a power source configured to supply power to at least the stepping motor.

The analogue electronic timepiece includes a timepiece case 115, the analogue display unit 109 is disposed on an outer surface of the timepiece case 115, and a movement 116 is disposed inside the timepiece case 115.

At least the oscillating circuit 101, the frequency divider circuit 102, the control circuit 103, the main drive pulse generating circuit 104, the corrected drive pulse generating circuit 105, the motor driver circuit 107, the stepping motor 108, the rotation detecting circuit 110, the operation allowance determination circuit 111, the voltage detection circuit 112, and the secondary cell 113 are components of the movement 116.

In general, a mechanical body of a timepiece including apparatuses such as a power source of a timepiece and a time reference is referred to as a movement. An electronic body of a timepiece may be referred to as a module. In a complete state as a timepiece, a dial and hands are mounted on the movement, which is housed in a timepiece case.

The oscillation circuit 101 and the frequency divider circuit 102 constitute a signal generation unit, and the analogue display unit 109 constitutes an alarm unit. The rotation detecting circuit 110 and the operation allowance determination circuit 111 constitute a rotation detection unit. The solar cell 114 constitutes a power generating unit configured to generate power and a charging unit configured to charge the secondary cell 113. The main drive pulse generating circuit 104 and the corrected drive pulse generating circuit 105 constitute a drive pulse generating unit. The main drive pulse generating circuit 104, the corrected drive pulse generating circuit 105, and the motor driver circuit 107 constitute a drive unit. The oscillating circuit 101, the frequency divider circuit 102, the control circuit 103, the main drive pulse generating circuit 104, the corrected drive pulse generating circuit 105, and the motor driver circuit 107 constitute a control unit. The oscillating circuit 101, the frequency divider circuit 102, the control circuit 103, the main drive pulse generating circuit 104, the corrected drive pulse generating circuit 105, the motor driver circuit 107, the rotation detecting circuit 110, and the operation allowance determination circuit 111 constitute a stepping motor control circuit.

The solar cell 114 generates power and charges the secondary cell 113. Power is supplied from the secondary cell 113 as the power source to the circuit elements of the analogue electronic timepiece including the stepping motor 108, whereby the analogue electronic timepiece is operated.

The voltage detection circuit 112 detects the voltage of the secondary cell 113 at a predetermined cycle, and when the voltage of the secondary cell 113 is lowered to a level equal to or lower than a predetermined voltage, the fact that the voltage of the secondary cell 113 is lowered to a level equal to or lower than the predetermined voltage is notified to encourage the user to charge the cell. The notification may be achieved by providing separately the alarm unit such as a speaker and performing thereby. Alternatively, the control circuit 103 may be configured to control the main drive pulse generating circuit 104 to drive the time-of-day hands of the analogue display unit 109 in a predetermined pattern to cause the same to make notification when the voltage detection circuit 112 detects the fact that the voltage of the secondary cell 113 is lowered to a level equal to or lower than the predetermined voltage.

The action of the time-of-day display as a normal operation will be described in brief. In FIG. 1, the oscillating circuit 101 generates a signal having a predetermined frequency, and the frequency divider circuit 102 divides the frequency of the signal generated by the oscillation circuit 101 and generates a time signal (for example, a signal at a cycle of one second) as a reference of time counting, and outputs the generated time signal to the control circuit 103.

The control circuit 103 counts the time signal and outputs a main drive pulse control signal to the main drive pulse generating circuit 104 so as to cause the stepping motor 108 to be rotationally driven by a main drive pulse P1 having energy according to the magnitude of a load or the voltage of the secondary cell 113 (the degree of reserve capacity of driving).

In the respective embodiments of the invention, a plurality of types of drive pulses are prepared as drive pulses for rotationally driving the stepping motor 108. A plurality of types (that is, a plurality of ranks) of main drive pulses P1 having different energy from each other, and a corrected drive pulse P2 having energy larger than the respective main drive pulses P1 are used as the drive pulses described above.

The main drive pulses P1 are drive pulses for rotationally driving the stepping motor 108 when moving the time-of-day hands (second hand, minute hand, and hour hand) under normal condition, and the corrected drive pulse P2 is a drive pulse for forcedly rotating the stepping motor 108 when the stepping motor 108 is failed to be rotated by the main drive pulses P1.

The main drive pulse generating circuit 104 outputs a main drive pulse P1 having energy of a rank corresponding to the main drive pulse control signal from the control circuit 103 to the motor driver circuit 107. The motor driver circuit 107 rotationally drives the stepping motor 108 by the main drive pulse P1. The stepping motor 108 is rotationally driven by the main drive pulse P1 and rotationally drives the time-of-day hands of the analogue display unit 109. Accordingly, when the stepping motor 108 is normally rotated, the current time-of-day display by the time-of-day hands is achieved by the analogue display unit 109.

The rotation detecting circuit 110 detects induced signals VRs exceeding a predetermined reference threshold voltage Vcomp from induced signals VRs generated by rotational free vibrations of the stepping motor 108 during a predetermined detection period DT.

The reference threshold voltage Vcomp is set so that, the rotation detecting circuit 110 detects induced signals VRs exceeding the predetermined reference threshold voltage Vcomp when a rotor (not illustrated) of the stepping motor 108 performs a constant rapid motion as, for example, in the case where the stepping motor 108 is rotated, and the induced signals VRs do not exceed the reference threshold voltage Vcomp when the rotor does not perform the constant rapid motion as, for example, in the case where the stepping motor 108 does not rotate.

As described later, in the respective embodiments of the invention, the detection period DT during which the condition of rotation of the stepping motor 108 is detected is divided into a plurality of time intervals.

The operation allowance determination circuit 111 compares the time-of-day and the time interval at which and in which the rotation detecting circuit 110 detects the induced signal VRs exceeding the reference threshold voltage Vcomp, determines a time interval in which the induced signal VRs is detected, and determines the degree of reserve capacity of drive energy (the induced signal VRs pattern).

In this manner, the rotation detecting circuit 110 detects the induced signals VRs exceeding the reference threshold voltage Vcomp generated by the stepping motor 108. The operation allowance determination circuit 111 determines which time interval in the detection period DT the corresponding induced signal VRs belong to, and determines the reserve capacity of driving of the drive pulse used for driving at that time on the basis of a pattern which indicates the time interval which the corresponding induced signal VRs belong to.

The control circuit 103 performs pulse control by outputting the main drive pulse control signal to the main drive pulse generating circuit 104 to cause the operation allowance determination circuit 111 to perform an action to upgrade the energy of the main drive pulse P1 by one rank (pulse up) or an action to degrade the energy of the main drive pulse P1 by one rank (pulse down) on the basis of the reserve capacity of driving determined, or perform pulse control by outputting a corrected drive pulse control signal to the corrected drive pulse generating circuit 105 to cause the corrected drive pulse generating circuit 105 to use the corrected drive pulse P2 for driving.

The main drive pulse generating circuit 104 and the corrected drive pulse generating circuit 105 output drive pulses in accordance with the control signals to the motor driver circuit 107, and the motor driver circuit 107 rotationally drives the stepping motor 108 on the basis of the corresponding drive pulses.

Figure 2:
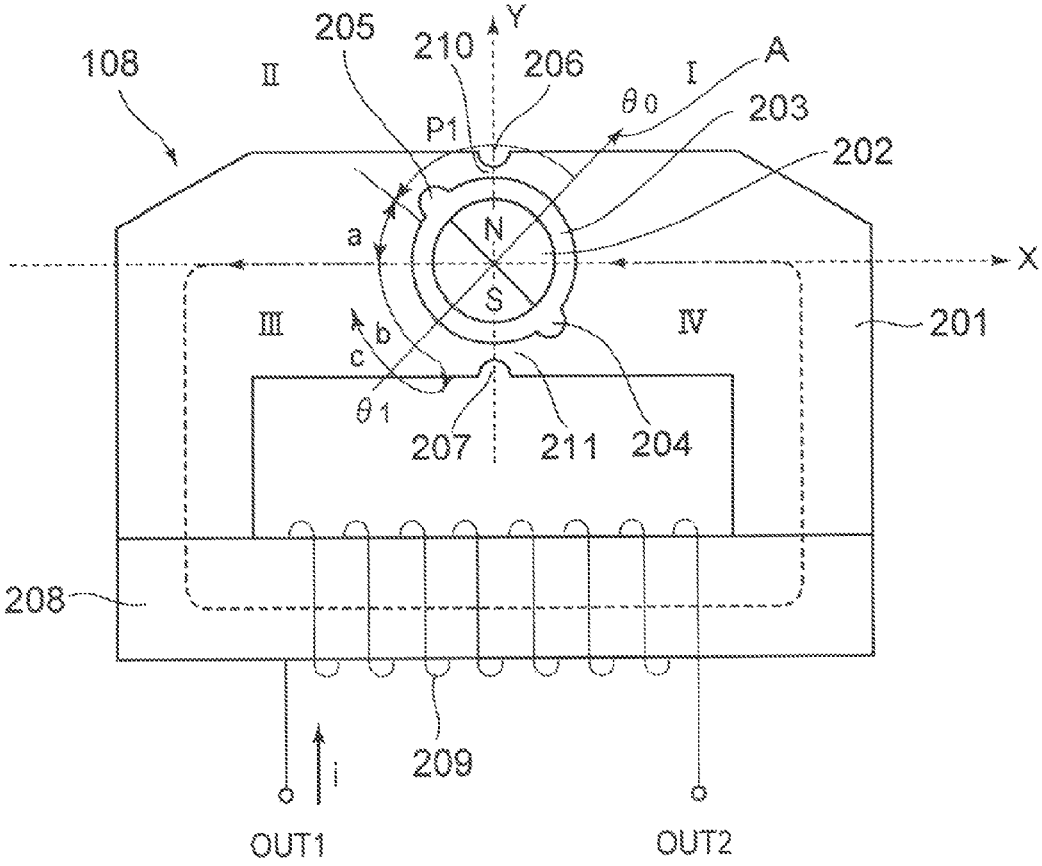
FIG. 2 is a configuration drawing of a stepping motor used in the analogue electronic timepieces according to the respective embodiments of the invention.

FIG. 2 is a configuration drawing of the stepping motor 108 which is used in the respective embodiments of the invention, and illustrates an example of a stepping motor for a timepiece which is generally used in the analogue electronic timepiece.

In FIG. 2, the stepping motor 108 includes a stator 201 having a rotor housing through hole 203, a rotor 202 disposed in the rotor housing through hole 203 so as to be capable of rotating therein, a magnetic core 208 joined to the stator 201, and a coil 209 wound around the magnetic core 208. When the stepping motor 108 is used in the analogue electronic timepiece, the stator 201 and the magnetic core 208 are fixed to a base panel (not illustrated) with screws (not illustrated) and are joined to each other. The coil 209 has a first terminal OUT1 and a second terminal OUT2.

The rotor 202 is magnetized in two polarities (S-polar and N-polar). A plurality of (two in this embodiment) notched portions (outer notches) 206 and 207 are provided on outer end portions of the stator 201 formed of a magnetic material at positions opposing to each other with the intermediary of the rotor housing through hole 203. Provided between the respective outer notches 206 and 207 and the rotor housing through hole 203 are saturable portions 210 and 211.

The saturable portions 210 and 211 are configured not to be magnetically saturated by a magnetic flux of the rotor 202 and to be magnetically saturated when the coil 209 is excited so that a magnetic resistance is increased. The rotor housing through hole 203 is formed into a circular hole shape having a plurality of (two in this embodiment) semicircular notched portions (inner notches) 204 and 205 integrally formed at opposed portions of the through hole having a circular contour.

The notched portions 204 and 205 constitute positioning portions for positioning a stop position of the rotor 202. In a state in which the coil 209 is not excited, the rotor 202 is stably stopped at positions corresponding to the above-described positioning portions, in other words, at a position where an axis of magnetic pole A of the rotor 202 extends orthogonally to a segment connecting the notched portions 204 and 205 (an angular position 90) as illustrated in FIG. 2. An XY coordinate space extending about an axis of rotation (center of rotation) of the rotor 202 as a center is divided into four quadrants (a first quadrant I to a fourth quadrant IV).

When the motor driver circuit 107 supplies a square-wave drive pulse between the terminals OUT1 and OUT2 of the coil 209 (for example, the first terminal OUT1 side is the positive pole and the second terminal OUT2 side is the negative pole), and allows a current i to flow in the direction indicated by an arrow in FIG. 2, a magnetic flux in the direction of an arrow of a broken line is generated in the stator 201. Accordingly, the saturable portions 210 and 211 are saturated and their magnetic resistance are increased, and then the rotor 202 rotates in a forward direction by 180° by a mutual action between a magnetic pole generated in the stator 201 and a magnetic pole of the rotor 202, and the axis of magnetic polarity stops stably at the angular position θ1. The direction of rotation (counterclockwise direction in FIG. 2) for causing the stepping motor 108 to rotationally drive and putting the same into a normal action (the movement of the time-of-day hands because the timepiece of this embodiment is an analogue electronic timepiece) is defined to be a forward direction (counter clockwise direction in FIG. 2) and the reverse direction (clockwise direction) is defined to be a reverse direction.

Subsequently, when the motor driver circuit 107 supplies a square-wave drive pulse having an opposite polarity to the terminals OUT1 and OUT2 of the coil 209 (the first terminal OUT1 side is the negative pole and the second terminal OUT2 side is the positive pole, so that the polarity is inverted from the driving described above), and allows a current to flow in the opposite direction from that indicated by an arrow in FIG. 2, a magnetic flux in the opposite direction from that indicated by an arrow of a broken line is generated in the stator 201. Accordingly, the saturable portions 210 and 211 are saturated first, and then the rotor 202 rotates in the same direction as that described above (forward direction) by 180° by a mutual action between a magnetic pole generated in the stator 201 and a magnetic pole of the rotor 202, and the axis of magnetic pole stops stably at the angular position 901.

In this manner, by supplying the signals having different polarities (alternating signals) to the coil 209, the operation is repeatedly performed, so that the rotor 202 is configured to be capable of rotating continuously in the forward direction by 180° each.

The control circuit 103 rotationally drives the stepping motor 108 by driving with a main drive pulses P1 having polarities different from each other alternately and, if the rotation is not achieved by the main drive pulse P1, rotationally drives the stepping motor 108 with a corrected drive pulse P2 having the same polarity as the corresponding main drive pulse P1.

FIG. 3 is a timing chart illustrating a case where the stepping motor 108 is driven by the main drive pulse P1 in the first and the second embodiments of the invention, also illustrating the degree of reserve capacity of the drive pulse, the rotational position of the rotor 202 of the stepping motor 108, and patterns of the induced signals VRs and pulse control actions indicating the condition of rotation.

In FIG. 3, reference sign P1 designates the main drive pulse P1 and also a driving period in which the rotor 202 is rotationally driven with the main drive pulse P1. Reference signs a to e designate areas showing the rotational positions of the rotor 202 when driven by the main drive pulse P1.

A predetermined time period including part of driving by the main drive pulse P1 and after the driving is represented as a detection period DT for detecting the condition of rotation, and the detection period DT is divided into a plurality of continuous time intervals (four time intervals from T0 to T3 in this embodiment). In this embodiment, a predetermined time period after the start of driving including part of the driving period driven by the main drive pulse P1 is represented by the first time interval T0, a predetermined time period after the first time interval T0 is represented by the second time interval T1, a predetermined time period after the second time interval T1 is represented by the third time interval T2, and a predetermined time period after the third time interval T2 is represented by the fourth time interval T3.

When the XY-coordinate space where the axis of magnetic pole A of the rotor 202 is located by its rotation is divided into the first quadrant I to the fourth quadrant IV about the rotor 202, the first time interval T0 to the fourth time interval T3 can be expressed as follows.

In other words, in a state of normal driving (that is, the state of rotation having an enough allowance of drive energy), the first time interval T0 corresponds to a time interval in which the condition of first forward rotation of the rotor 202 within the second quadrant about the rotor 202 with the axis of magnetic pole A of the rotor 202 located between the inner notch 205 (a maximum magnetic potential position to be reached first when the axis of magnetic pole A is rotated) and the direction of a horizontal magnetic pole (the X-axis direction of the stator 201) is determined, the second time interval T1 corresponds to a time interval in which the condition of forward rotation of the rotor 202 in the third quadrant III in the space about the rotor 202 is determined, the third time interval T2 corresponds to a time interval in which the condition of first forward rotation and the state of first reverse rotation of the rotor 202 is determined in the third quadrant III, and the fourth time interval T3 corresponds to a time interval in which the condition of rotation after the first reverse rotation of the rotor 202 is determined in the third quadrant III.

Here, the normal driving means a state in which a load driven under a normal circumstance may be driven normally by the main drive pulse P1 and, in this embodiment, the normal driving is defined as a state in which the time-of-day hands as loads are driven normally and stably with an allowance in energy by the main drive pulse P1.

In this manner, in this embodiment, the first time interval T0 in which the condition of rotation between the inner notch 205 and the horizontal magnetic pole is detected is provided so that the induced signal VRs generated during the driving by the main drive pulse P1 can be detected. If the induced signal VRs exceeding the reference threshold voltage Vcomp is detected in the first time interval T0, it is determined that a rapid rotation is ongoing and hence the energy of the main drive pulse P1 is sufficient, so that the pulse control such as pulse down is performed.

In addition, with the configuration in which the time interval T0 for detecting the rotation is provided within the driving period of the main drive pulse, then time intervals (in the embodiment, the time intervals T1 to T3) for detecting the normal rotation are provided, the induced signal VRs may be detected in a non-driving period within the main drive pulse P1, and even when being driven by the main drive pulse P1 having large energy, the induced signal VRs generated within the driving period by the main drive pulse P1 may be detected and hence the condition of rotation may be determined with high degree of accuracy.

In other words, in a state in which the drive energy is still larger than the normal driving (that is, the state of driving with excessive energy having a large allowance of drive energy), the first time interval T0 corresponds to a time interval in which the condition of first forward rotation of the rotor 202 is determined within the second quadrant about the rotor 202 with the axis of magnetic pole A of the rotor 202 located between the inner notch 205 and the direction of the horizontal magnetic pole, the second time interval T1 corresponds to a time interval in which the condition of forward rotation of the rotor 202 is determined in the third quadrant III in the space about the rotor 202, the third time interval T2 corresponds to a time interval in which the condition of first forward rotation and the state of first reverse rotation of the rotor 202 is determined in the third quadrant III, and the fourth time interval T3 corresponds to a time interval in which the condition of rotation after the first reverse rotation of the rotor 202 is determined in the third quadrant III.

In the state in which the drive energy is slightly smaller than the normal driving (the state of driving with small load increment, the condition of rotation with small allowance of energy), the second time interval T1 corresponds to a time interval in which the state of forward rotation of the rotor 202 is determined in the second quadrant II, the third time interval T2 corresponds to a time interval in which the state of first forward rotation and the state of first reverse rotation of the rotor 202 is determined in the third quadrant III, and the fourth time interval T3 corresponds to a time interval in which the condition of rotation in and after the first reverse rotation of the rotor 202 is determined in the third quadrant III. In this case, the first time interval T0 is part of period driven by the main drive pulse P1.

In a state in which the drive energy is further smaller than the condition of rotation with energy having small allowance (the state of driving with large load increment, the condition of rotation with least reserve of energy), the second time interval T1 corresponds to a time interval in which the condition of forward rotation of the rotor 202 is determined in the second quadrant II, the third time interval T2 corresponds to a time interval in which the state of forward rotation of the rotor 202 is determined in the second quadrant II and the state of first forward rotation of the rotor 202 is determined in the third quadrant III, and the fourth time interval T3 corresponds to a time interval in which the condition of rotation in and after the first reverse rotation of the rotor 202 in the third quadrant III is determined. In this case as well, the first time interval T0 is part of time period during the driving by the main drive pulse P1.

In a state in which the drive energy is further smaller than the condition of rotation with least reserve of energy (the state of driving with extremely large load increment, non-rotating state due to insufficient energy), the rotor 202 cannot be rotated.

For example, in FIG. 3, in the stepping motor control circuit of this embodiment, in the normal driving state, the induced signal VRs generated within the driving period P of the main drive pulse P1 is detected in the first time interval T0, the induced signal VRs generated in an area b is detected in the second time interval T1 and the third time interval T2, the induced signal VRs generated in an area c is detected it the third time interval T2, and the induced signal VRs generated after the area c is detected in the fourth time interval T3.

The case where the rotation detection circuit 110 detects the induced signal VRs exceeding the reference threshold voltage Vcomp is expressed as a determination value "1", and the case where the rotation detection circuit 110 cannot detect the induced signal VRs exceeding the reference threshold voltage Vcomp is expressed as a determination value "0". In the example of the normal driving shown in FIG. 3, a pattern (1, 0, 1, 0) is obtained as a pattern indicating the condition of rotation (the determination value in the first time interval, the determination value in the second time interval, the determination value in the third time interval, and the determination value in the fourth time interval) by the operation allowance determination circuit 111.

In this case, in the first to the third embodiments of the invention, the control circuit 103 determines that the allowance of the drive energy is large, and performs pulse control by degrading the drive energy by one rank (pulse down), and changing the pulse to the main drive pulse P1 which is one rank lower.

In the first to the third embodiments of the invention, since the rotor 202 cannot be rotated in the driving state with an extremely large load increment, the control circuit 103 performs such pulse control as driving the rotor 202 by the corrected drive pulse P2 to forcedly rotate the rotor 202 and then upgrading the main drive pulse P1 by one rank (pulse up).

Although detailed description will be given later, the pulse control actions according to the fourth and the fifth embodiments of the invention are configured to be different from the pulse control action of the first to the third embodiments.

FIG. 4 is a determination chart showing the pulse control actions common to the first to the third embodiments of the invention. In FIG. 4, as described above, the case where the induced signal VRs exceeding the reference threshold voltage Vcomp is detected is expressed as the determination value "1", and the case where the induced signal VRs exceeding the reference threshold voltage Vcomp cannot be detected is expressed as the determination value "0". The expression "1/0" means that the determination values "1" and "0" are both applicable.

The rotation detecting circuit 110 detects the presence or absence of the induced signal VRs exceeding the reference threshold voltage Vcomp. Then, the operation allowance determination circuit 111 determines the pattern of the induced signal VRs (indicating the degree of allowance of the energy), the control circuit 103 references the determination chart in FIG. 4 stored in the control circuit 103, and performs pulse control described later such as pulse up or pulse down of the main drive pulse P1, or driving by the corrected drive pulse P2 on the basis of the pattern described above, thereby rotationally controlling the stepping motor 108.

Figure 5:
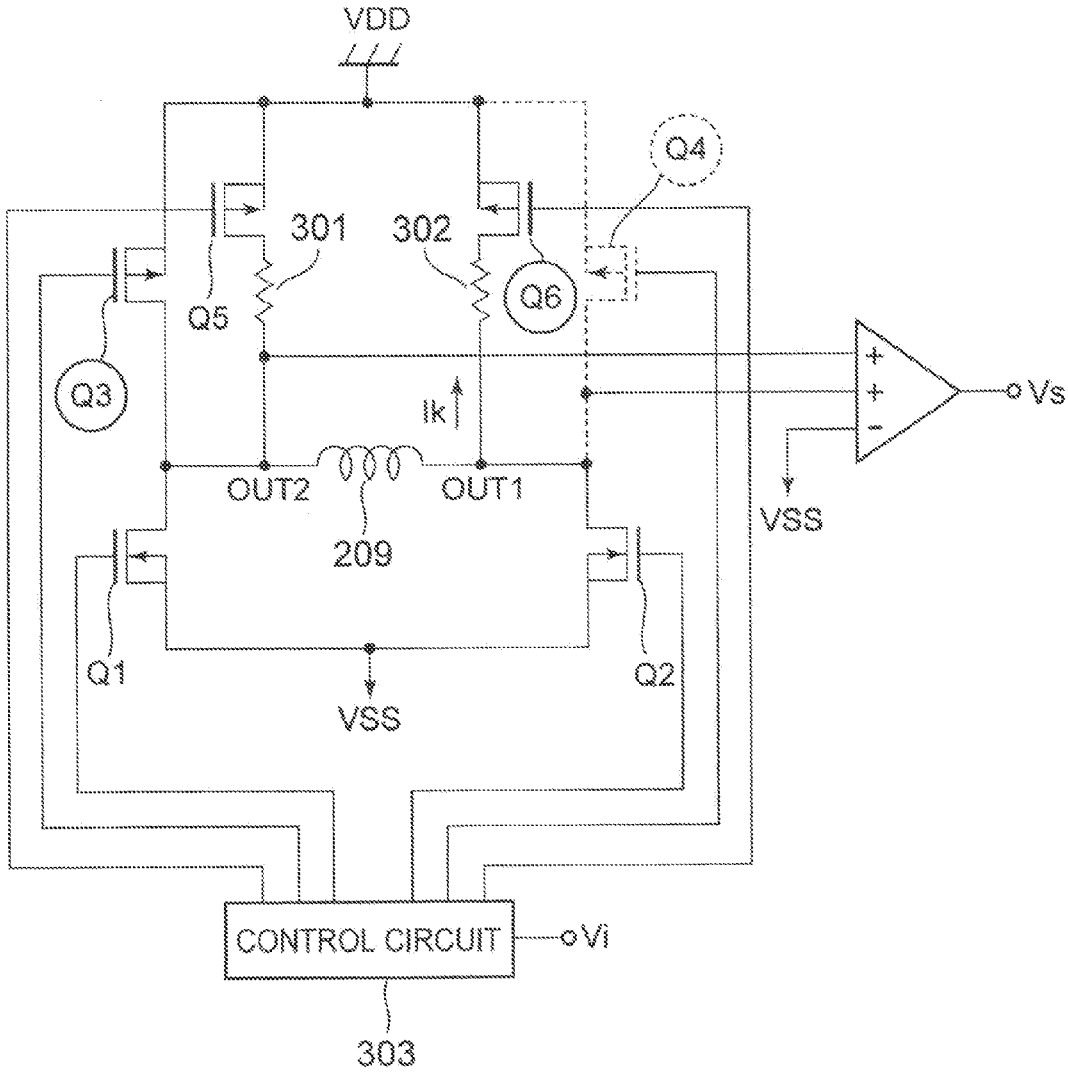
FIG. 5 is a partial detailed circuit diagram common to the stepping motor control circuits and the analogue electronic timepieces according to the respective embodiments of the invention.

FIG. 5 is a partial detailed circuit diagram common to the stepping motor control circuits and the analogue electronic timepieces according to the respective embodiments of the invention, and is a partly detailed circuit diagram showing the motor driver circuit 107 and the rotation detecting circuit 110.

Although detailed description of actions will be given later, a switch control circuit 303 supplies a drive current in the forward direction or in the reverse direction with respect to the coil 209 by bringing transistors Q2 and Q3 simultaneously into an ON state or bringing transistors Q1 and Q4 simultaneously into an ON state in response to a control signal Vi supplied from the main drive pulse generating circuit 104 or the corrected drive pulse generating circuit 105 at the time of rotationally driving, thereby rotationally driving the stepping motor 108.

In the first embodiment of the invention, a drive pulse having a waveform repeating a supplying state in which the drive energy is supplied and a supply stop state in which the supply of the drive energy is stopped alternately at a predetermined cycle (comb-shaped drive pulse) is used as the main drive pulse P1 and the corrected drive pulse P2.

At the time of detecting the rotation, control is made to generate the induced signal VRs in a detection resistance 301 or 302 by controlling the transistors Q3 to Q6 into any one of the ON state, the OFF state, and the switching state.

The transistors Q1 and Q2 are components of the motor driver circuit 107, and the transistors Q5 and Q6 and the detected resistances 301 and 302 are components of the rotation detecting circuit 110. Also, the transistors Q3 and Q4 are components used for both the motor driver circuit 107 and the rotation detecting circuit 110. The detected resistances 301 and 302 are elements having the same value of resistance, and constitute a detection element.

Figure 6:
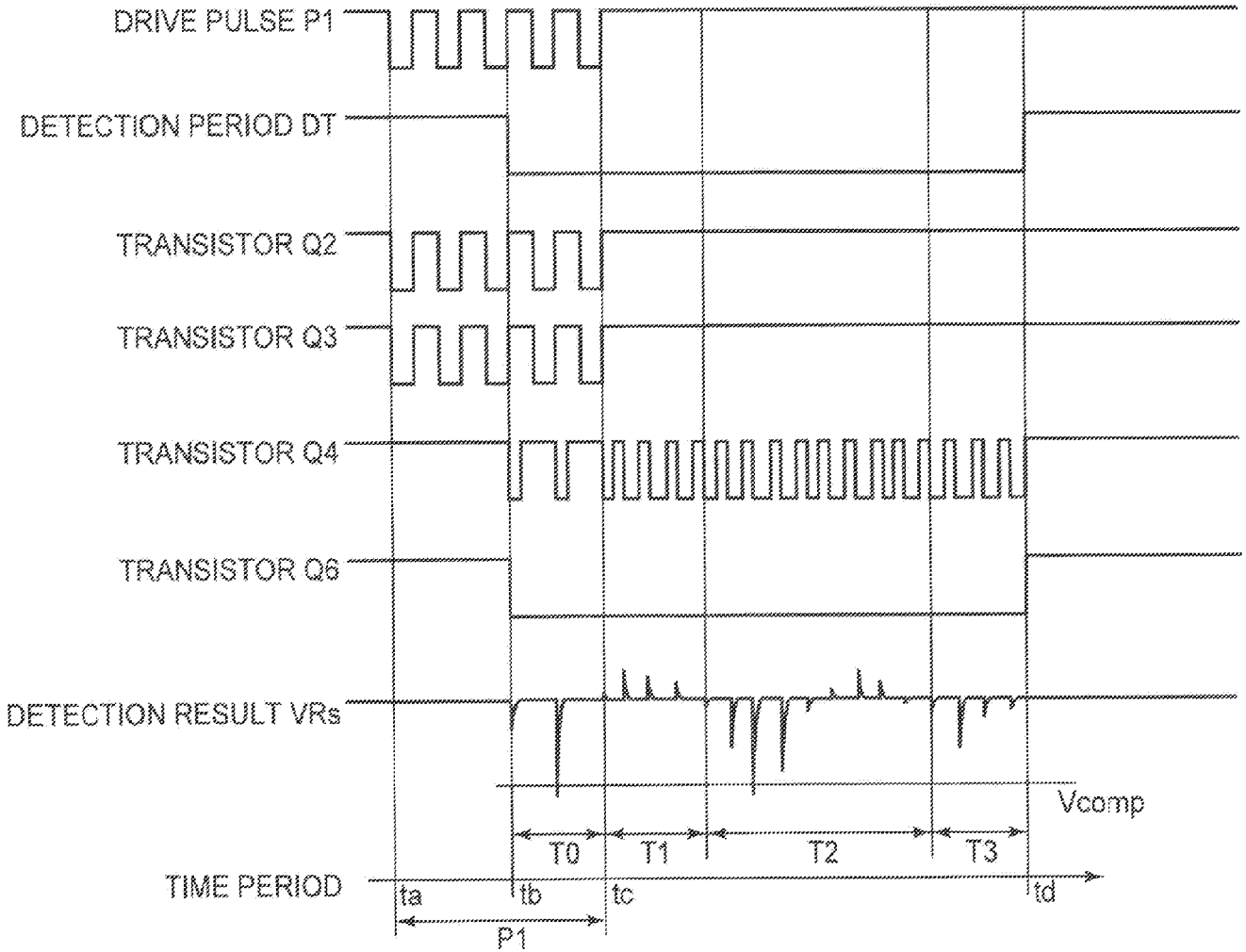
FIG. 6 is a timing chart common to the stepping motor control circuits and the analogue electronic timepieces according to the first to the third embodiments of the invention.

FIG. 6 is a timing chart of the stepping motor control circuits and the analogue electronic timepieces common to first and the second embodiments of the invention.

When rotationally driving the stepping motor 108, a drive current i in the direction indicated by an arrow is supplied to the coil 209 of the stepping motor 108 by the comb-shaped main drive pulse P1 by driving transistors Q2 and Q3 simultaneously at a predetermined cycle by the comb-shaped main drive pulse P1 so as to repeat the ON state (supplying state) and the OFF state (supply stop state) during a driving period P from time-of-day ta to tc. Accordingly, when the stepping motor 108 rotates, the rotor 202 rotates by 180° in the forward direction.

In contrast, the detection period DT starts at time-of-day tb within the driving period P (time-of-day ta to tc) of the main drive pulse P1. In other words, in the time-of-day tb to tc (that is, the first time interval T0) within the driving period P of the main drive pulse P1, the rotation detecting circuit 110 brings the transistor Q6 into the ON state, and brings the transistor Q4 into the OFF state in the first state and into the ON state in the second state, so that the induced signal VRs generated in the detected resistance 302 is detected. At this time, the time width during which the transistor Q4 is kept in the ON state is shorter than the time width for the second state. In this manner, the transistor Q4 is switched synchronously with the comb-shaped waveform of the main drive pulse P1.

When the driving by the main drive pulse P1 is stopped at the time-of-day tc, the transistor Q4 is driven so as to be switched in a cycle shorter than the above-described cycle from then onward until a time-of-day td at which the detection period DT terminates, whereby the detection of rotation with high degree of accuracy is performed.

A comparator 304 compares the induced signal VRs and the predetermined reference threshold voltage Vcomp and outputs a detection signal Vs indicating whether or not the induced signal VRs exceeds the reference threshold voltage Vcomp to the operation allowance determination circuit 111.

The reference threshold voltage Vcomp is set in such a manner that the induced signal VRs exceeding the reference threshold voltage Vcomp is generated when the rotor 202 rotates at a speed exceeding a predetermined speed as in the case where the stepping motor 108 is rotated, and the induced signal VRs exceeding the reference threshold voltage Vcomp is not generated when the rotor 202 rotates at a speed equal to or lower than the predetermined speed as in the case where the stepping motor 110 cannot be rotated.

The operation allowance determination circuit 111 determines whether or not the rotation detecting circuit 110 detects the induced signal VRs exceeding the reference threshold voltage Vcomp in the time intervals T0 to T3, and the pattern of the induced signal VRs (the value of determination in the first time interval T0, the value of determination in the second time interval T1, the value of determination in the third time interval T2, and the value of determination in the fourth time interval T3) is output as a result of determination to the control circuit 103.

The control circuit 103 determines the condition of rotation of the stepping motor 108 on the basis of the pattern from the operation allowance determination circuit 111, and performs pulse control such as pulse up.

The respective transistors Q1 to Q6 are controlled to perform the same actions also in the next cycle after the termination of the cycle illustrated in FIG. 6. In other words, the transistors Q1 and Q4 are driven so as to be switched in the same cycle as those of the transistors Q2 and Q3 instead of the transistors Q2 and Q3, and the driving by the comb-shaped main drive pulse P1 is performed. Also, the transistor Q3 is driven so as to be switched at the same timing as the transistor Q4 instead of the transistor Q4. Also, the transistor Q5 is driven into the ON state instead of the transistor Q6.

An induced signal VRs which is generated by the rotation of the stepping motor 108 is generated in the detection resistance 301, and the comparator 304 compares the induced signal with the reference threshold voltage Vcomp and outputs a detection signal Vs. The operation allowance determination circuit 111 determines the pattern of the induced signal VRs on the basis of the detection signal, and output the determined pattern to the control circuit 103.

The control circuit 103 determines the condition of rotation of the stepping motor 108 on the basis of the pattern from the operation allowance determination circuit 111, and performs pulse control such as pulse up.

By repeating the above-described two cycles alternately, the rotation control of the stepping motor 108 is performed. In the case of the non-rotation, the driving by the corrected drive pulse P2 is performed, but the rotation detecting action is not performed in this case.

Figure 7:
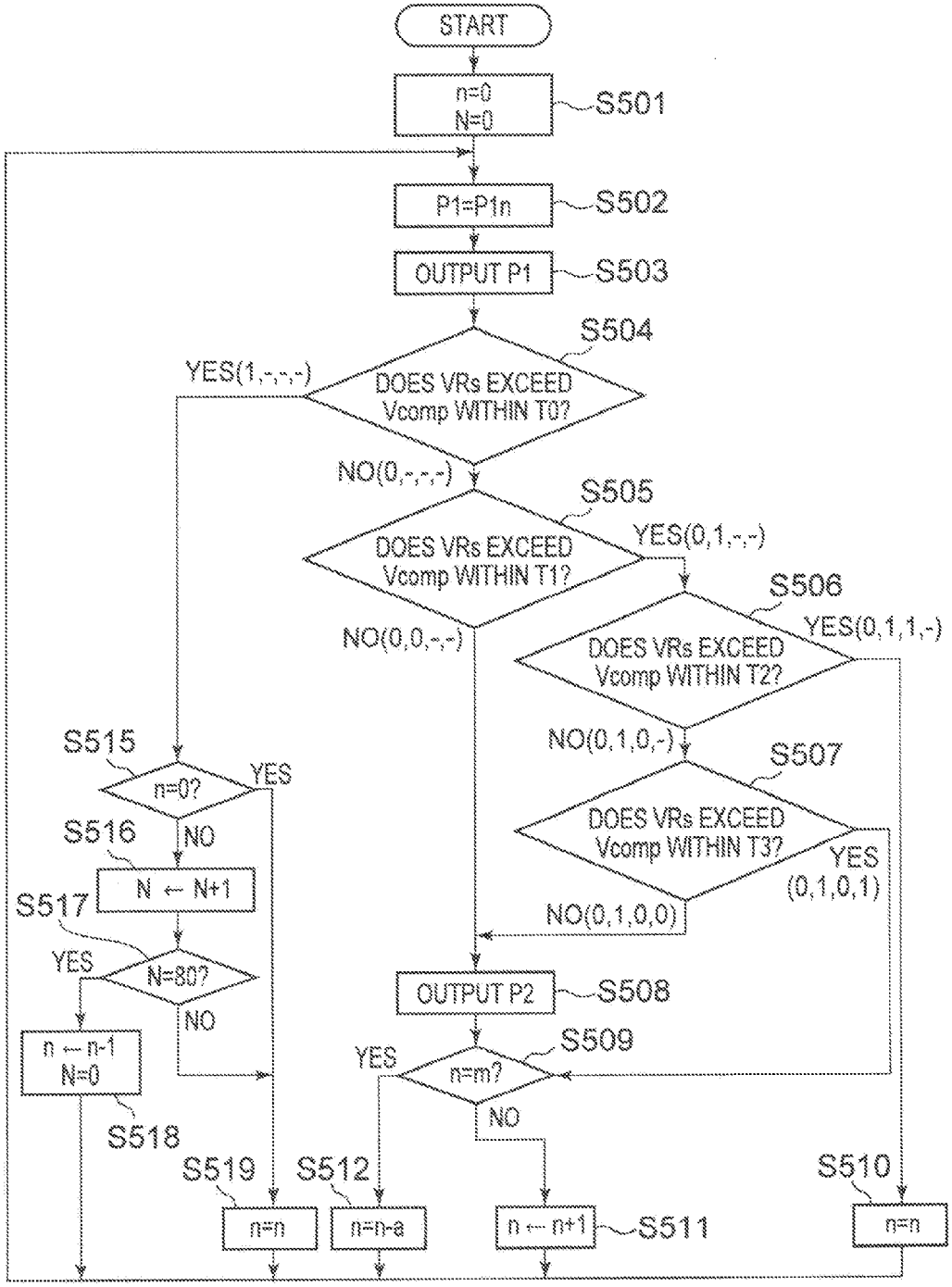
FIG. 7 is a flowchart relating to the stepping motor control circuits and the analogue electronic timepieces according to the first embodiment of the invention.

FIG. 7 is a flowchart showing the actions of the stepping motor control circuit and the analogue electronic timepiece according to the first embodiment of the invention, and is a flowchart mainly showing the process in the control circuit 103.

Referring now to FIG. 1 to FIG. 7, the action in the first embodiment of the invention will be described in detail.

In FIG. 1, the oscillation circuit 101 generates a reference clock signal of a predetermined frequency, and the frequency divider circuit 102 divides the frequency of the signal generated by the oscillation circuit 101 and generates a time signal as a reference of time counting, and outputs the same to the control circuit 103.

The control circuit 103 counts the time signal and performs a time counting action. Then, the control circuit 103 firstly sets an energy rank n of a main drive pulse Pin and a counted number N indicating the number of times of the continuous driving by the same main drive pulse to zero (Step S501 in FIG. 7), and then outputs a main drive pulse control signal to rotationally drive the stepping motor 108 with a main drive pulse P10 with a minimum pulse width (Steps S502 and S503).

The main drive pulse generating circuit 104 outputs the main drive pulse P10 corresponding to the control signal to the motor driver circuit 107 in response to the control signal from the control circuit 103. The motor driver circuit 107 rotationally drives the stepping motor 108 by the main drive pulse P10. The stepping motor 108 is rotationally driven by the main drive pulse P10 and rotationally drives the time-of-day hands of the analogue display unit 109. Accordingly, when the stepping motor 108 is normally rotated, the current time-of-day display by the time-of-day hands is achieved as needed by the analogue display unit 109.

The control circuit 103 performs determination whether or not the rotation detection circuit 110 detects the induced signal VRs of the stepping motor 108 exceeding the predetermined reference threshold voltage Vcomp, and whether or not the operation allowance determination circuit 111 determines that a detected time t of the induced signal VRs falls within the time interval T0 (that is, determination whether or not the induced signal VRs exceeding the reference threshold voltage Vcomp is detected within the first time interval T0) (Step S504).

If the control circuit 103 determines that the induced signal VRs exceeding the reference threshold voltage Vcomp is not detected within the time interval T0 in the process step S504 (it is a case of the pattern (0, -, -, -), where the determination value "-" means that the determination value may either be "1" or "0"), in the same manner, whether or not the induced signal VRs exceeding the reference threshold voltage Vcomp is detected within the time interval T1 is determined (Step S505).

If the control circuit 103 determines that the induced signal VRs exceeding the reference threshold voltage Vcomp is not detected within the time interval T1 in the process step S505 (it is a case of the pattern (0, 0, -, -), and the case of non-rotation in FIG. 3), the stepping motor 108 is controlled to be driven by the corrected drive pulse P2 having the same polarity as that of the main drive pulse P1 in the process step S503 (Step S508).

Subsequently, if the rank n of the corresponding main drive pulse P1 is not a highest rank m, the control circuit 103 upgrades and changes the main drive pulse P1 by one rank to a main drive pulse P1 (n+1). Then, the procedure goes back to the process step S502, and the main drive pulse P1 (n+1) is used for the next driving (Steps S509 and S511).

If the rank n of the main drive pulse P1 is the highest rank m in the process step S509, the control circuit 103 degrades the main drive pulse P1 by one rank to a main drive pulse P1 (n−a) having a smaller energy by a predetermined amount. Then, the procedure goes back to the process step S502 (Step S512), and the main drive pulse P1 (n−a) is used for the next driving. In this case, since the rotation is not possible even with the drive pulse P1max, which is the drive pulse having the maximum energy rank m in the main drive pulse P1, waste of energy caused by driving with the main drive pulse P1max having the maximum energy rank m for the next driving may be reduced. At this time, the main drive pulse may be changed to the main drive pulse P10 having the minimum energy in order to achieve a high power-saving effect.

If the control circuit 103 determines that the induced signal VRs exceeding the reference threshold voltage Vcomp is detected within the time interval T1 in the process step S505 (it is a case of the pattern (0, 1, -, -)), in the same manner, whether or not the induced signal VRs exceeding the reference threshold voltage Vcomp is detected within the time interval T2 is determined (Step S506).

If the control circuit 103 determines that the induced signal VRs exceeding the reference threshold voltage Vcomp is not detected within the time interval T2 in the process step S506 (it is a case of the pattern (0, 1, 0, -)), whether or not the induced signal VRs exceeding the reference threshold voltage Vcomp is detected within the time interval T3 is determined (Step S507).

If the control circuit 103 determines that the induced signal VRs exceeding the reference threshold voltage Vcomp is not detected within the time interval T3 in the process step S507 (it is a case of the pattern (0, 1, 0, 0)), the procedure goes to the process step S508.

If the control circuit 103 determines that the induced signal VRs exceeding the reference threshold voltage Vcomp is detected within the time interval T3 in the process step S507 (it is a case of the pattern (0, 1, 0, 1)), the procedure goes to the process step S509.

If the control circuit 103 determines that the induced signal VRs exceeding the reference threshold voltage Vcomp is detected within the time interval T2 in the process step S506 (it is a case of the pattern (0, 1, 1, -)), the procedure goes back to Step S502 in a state in which the rank of the main drive pulse P1 is maintained without change (Step S510).

In contrast, if the control circuit 103 determines that the induced signal VRs exceeding the reference threshold voltage Vcomp is detected within the time interval T0 in the process step S504 (it is a case of the pattern (1, -, -, -)), whether or not the main drive pulse P1 is the Lowest rank 0 is determined (Step S515).

if the control circuit 103 determines that the rank n of the main drive pulse P1 is not the lowest rank 0 in the process step S515, the counted value N indicating the number of times of continuous driving is incremented by one (Step S516), and whether or not the counted value N reaches a predetermined number of times (80 times in this embodiment) is determined (Step S517).

If the predetermined number of times is not reached, the control circuit 103 goes to the process step S502 without changing the rank of the main drive pulse P1 (Step 519), and if the predetermined number of times is reached, the rank of the main drive pulse P1 is degraded by one rank, the counted value N is reset to "0", and the procedure goes back to the process step S502 (Step S518).

If the control circuit 103 determines that the rank n of the main, drive pulse P1 is tire lowest rank 0 in the process step S515, the procedure gees to the process step S51.9, and goes back to the process step S502 without changing the rank n of the main drive pulse P1.

in this manner, the stepping motor control circuit of the first embodiment includes the rotation detection unit configured to detect the condition, of rotation of the stepping motor 108 on the basis of she induced signal. VPs generated in the driving coil 209 of the stepping motor 108 in the detection period DT in which the condition of rotation of the stepping motor 108 is detected, and the control unit configured to rotationally drive the stepping motor 108 by supplying a drive signal to the driving coil 209 of the stepping motor 103 in the driving period P in which the stepping motor 108 is rotationally driven, wherein the driving period P and part of the detection ported DT overlap in the first time interval T0, and the control unit is characterized by stopping supply of the drive signal with respect to the driving coil 209 of the stepping motor 108 in the first time interval T0 within the driving period P.

Here, the main drive pulse P1 is a comb-shaped main drive pulse P1 in which the supply state in which the drive signal is supplied and the supply stop state in which the supply of the drive signal is stopped are repeated alternately at a predetermined cycle in the driving period P, and the rotation detection unit may be configured to detect the induced signal VRs in the supply stop state in the first time interval T0.

The detection period DT is divided into the plurality of time intervals T0 to T3 including the first time interval. T0 and at least one time interval provided after the first time interval T0, and the rotation detection unit may be configured to defect the condition of rotation, of the stepping motor 108 on the basis of the pattern of the induced signal VRs exceeding the reference threshold voltage Vcomp generated in the plurality of time intervals T0 to T3.

The stepping motor 108 may be configured to include the rotor 202 and the stator 201 including the rotor housing through hole 203 configured to house the rotor 202 therein, so as to be rotatable and the positioning notched portions 204 and 205 provided integrally with the rotor housing through hole 203 and configured to determine the stable still position of the rotor 202, in which the first trine interval T0 is a time interval in which the condition of rotation of the rotor 202 between the first positioning notch 205 where the axis of magnetic pole A passes when the rotor 202 is rotated and the horizontal magnetic pole of the stator 201.

Also, a configuration in which the drive signal includes a plurality of types of the main drive pulses P1 having energies different from each other, when the rotation detection unit detects the induced signal VRs exceeding the predetermined reference threshold voltage Vcomp in the first time interval T0, the control unit drives with the degraded (pulse down) main drive pulse P1 is also applicable.

A configuration in which the detection period DT includes the first time interval 10, the second time interval T1 continuing after the first time interval T0, the third time interval T2 continuing after the second time interval T1, and the fourth time interval T3 continuing after the third time interval T2, and the control unit degrades the main drive pulse P1 when the rotation detection unit detects the induced signal VPs exceeding the reference threshold voltage Vcomp in the first time interval T0 and performs pulse control on the basis of the pattern of the induced signal VRs exceeding the reference threshold voltage Vcomp in the second time interval T1 to the fourth time interval T3 when the induced signal VRs exceeding the reference threshold voltage Vcomp is not detected in the first time interval T0 is applicable.

In this manner, since the non-driving period is provided within the driving period P of the main drive pulse P1 to determine the condition of rotation by detecting the induced signal VRs generated during the non-drive period, detection of rotation with high degree of accuracy is enabled with a simple configuration even when a drive pulse having large drive energy is used for driving.

In addition, by using the driving coil 209 both for the rotational driving and the detection of rotation, accurate detection of rotation including she driving period P of the stepping motor 108 is achieved with the simple configuration without providing a coil specific for detection of rotation.

Also, even when a drive pulse having large drive energy is used, detection of rotation with high degree of accuracy is enabled with the simple configuration without erroneous determination of the condition of rotation, so that accurate pulse control is enabled.

Furthermore, a drive pulse having large drive energy which is compatible with a high load may be employed, and hence prevision of a movement with high compatibility with loads is advantageously achieved.

Although the induced signal VRs of the drive pulse having large drive energy in the third quadrant III is small, erroneous determination of detection of rotation may be avoided. In addition, it is possible to confirm the fact that the rotation goes beyond the maximum magnetic potential position in the second quadrant II. In order to obtain the state of rotation of the rotor in the drive pulse, the supply stop period may be allocated to the rotation detection time period in the comb-shaped (chopping) drive pulse, so that the detection of rotation is achieved in a short time.

Since the movement according to the first embodiment of the invention is provided with the stepping motor control circuit as described above, an analogue electronic timepiece capable of detection of rotation with high degree of accuracy may be constructed in a simple configuration even when being driven by a drive pulse having large energy.

Since the analogue electronic timepiece according to the first embodiment of the invention is provided with the movement as described above, detection of rotation smith high degree of accuracy is enabled in a simple configuration even when being driven by a drive pulse having large energy, so that an accurate movement of the hands is achieved.

Figure 8:
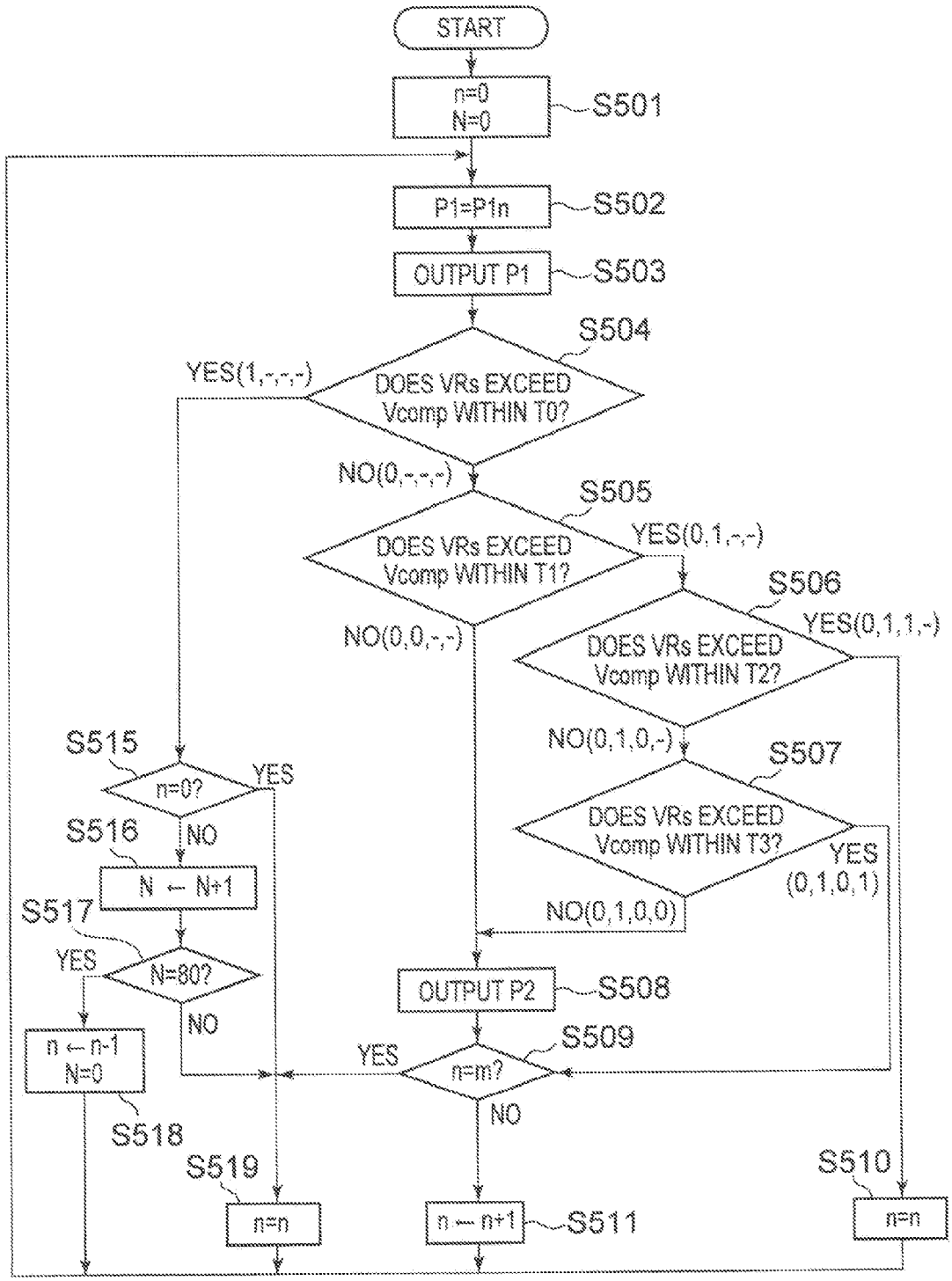
FIG. 8 is a flowchart relating to the stepping motor control circuits and the analogue electronic timepieces according to the second embodiment of the invention.

FIG. 8 is a flowchart showing the action of the stepping motor control circuit, the movement, and the analogue electronic timepiece according to the second embodiment of the invention, and portions performing the same process as those in FIG. 7 are designated by the same reference numerals.

The block diagrams and the pulse control actions according to the second embodiment are the same as those in FIG. 1 to FIG. 6.

In the first embodiment, when the rank of the main drive pulse P1 is the highest rank, power saving is achieved by degrading the rank of the main drive pulse P1 to a lower rank (Step S509 and S512 in FIG. 7). However, in the second embodiment, the pr tore as is simplified by eliminating the change of the rank of the main drive pulse P1 as shown in FIG. 8 (Step S509 and S519). Other actions are the same as those in the first embodiment.

In the second embodiment as well, detection of rotation precisely including the driving period P of she stepping motor 108 is achieved in a simple configuration, in the same manner as in the first embodiment. There is also an advantage such that compact and accurate movement of the hands is achieved.

Figure 9:
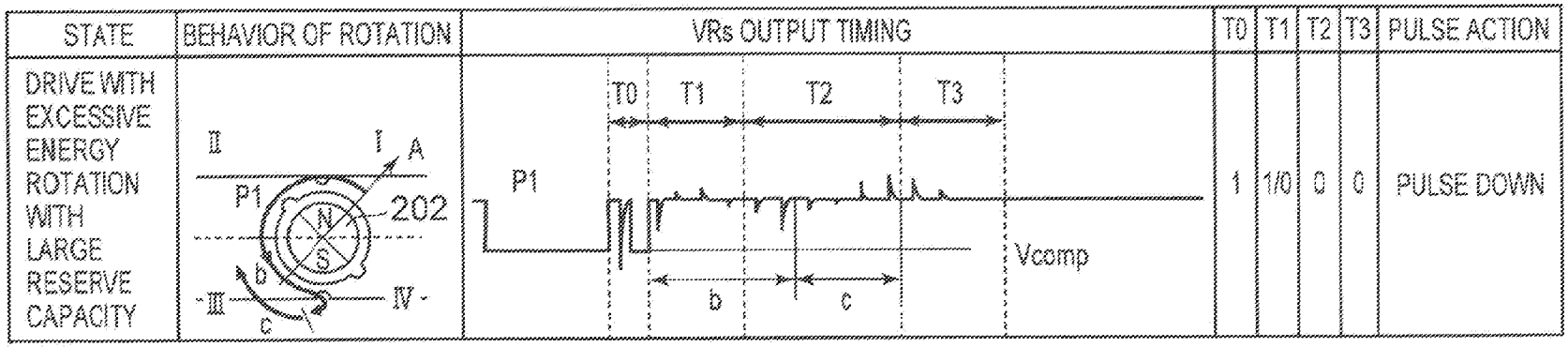
FIG. 9 is a timing chart common to the stepping motor control circuits and the analogue electronic timepieces according to the third embodiment of the invention.

FIG. 9 is a timing chart showing the actions of the stepping motor control circuit, the movement, and the analogue electronic timepiece according to the third embodiment of the invention.

In the first and the second embodiments, the comb-shaped drive pulses are used as the main drive pulse P1 and the corrected drive pulse P2. However, in the third embodiment, a waveform, drive pulse obtained by eliminating the detection period DT from a square-wave drive pulse is used as the main drive pulse P1 and a square-wave drive pulse is used as the corrected drive pulse P2.

In the third, embodiment, as the timing in the condition of rotation with large amount of reserve capacity shown in FIG. 9, the main drive pulse P1 is a waveform drive pulse obtained by eliminating the first time interval T0 from the square-wave pulse continuing for the driving period P. In other words, the main drive pulse P1 is a drive pulse provided so that the detection period DT overlaps with part of the square waveform pulse in the driving period P. The overlapped portion corresponds to the first time interval T0. Subsequent to the first time interval, the second time interval T1, the third time interval T2, and the fourth time interval T3 are provided. Other configurations and actions are the same as those in the first and the second embodiments.

In the third embodiment, since the main drive pulse P1 has a waveform obtained by eliminating the first time interval T0 from the square-wave pulse continuing for the driving period P, detection, of rotation precisely including the driving period P of the stepping motor 108 is achieved in a simple configuration in the same manner as in the first embodiment. There is also an advantage such that compact and accurate movement of the hands is achieved.

Figure 11:
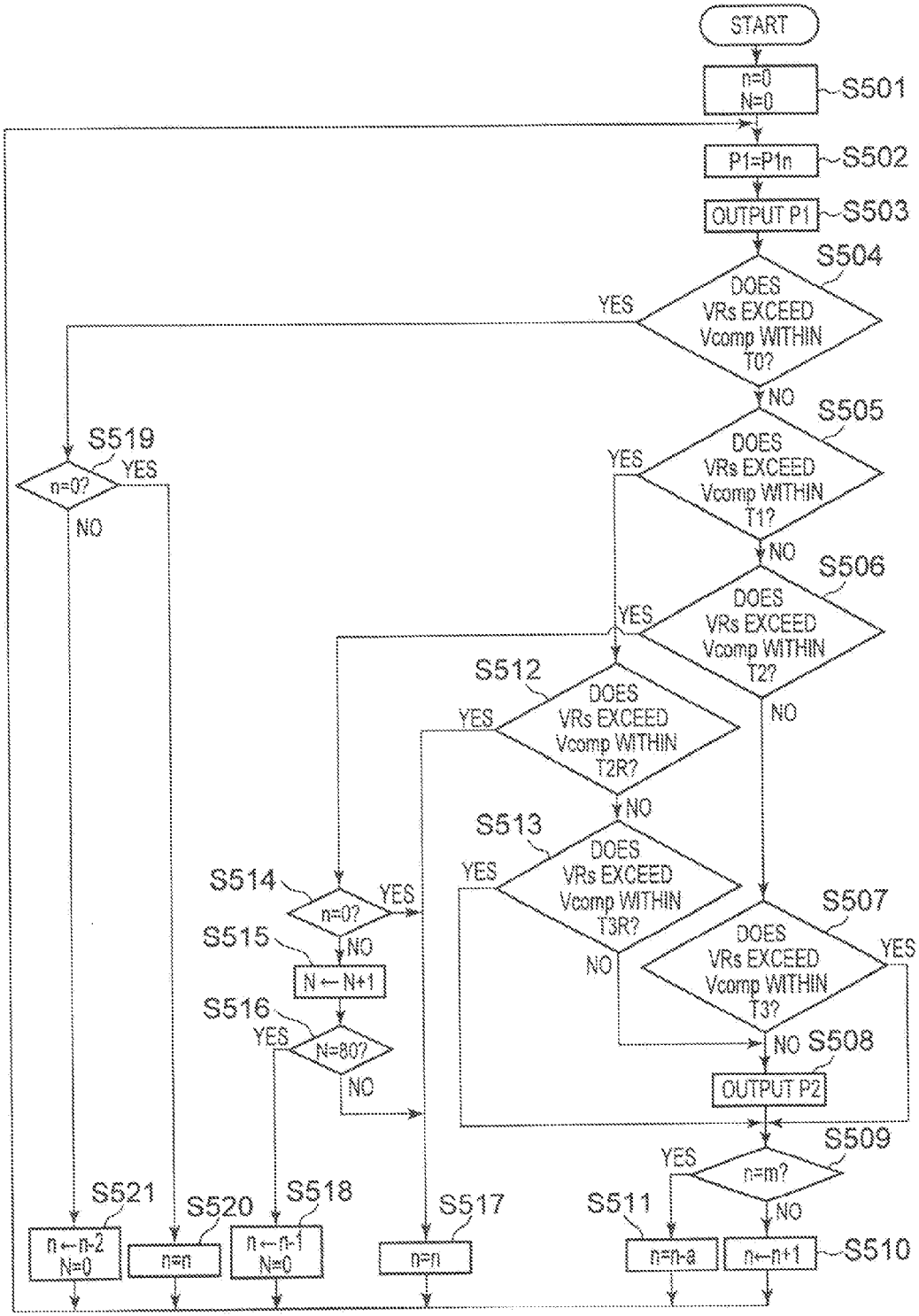
FIG. 11 is a flowchart showing an action in the fourth embodiment of the invention.
Figure 12:
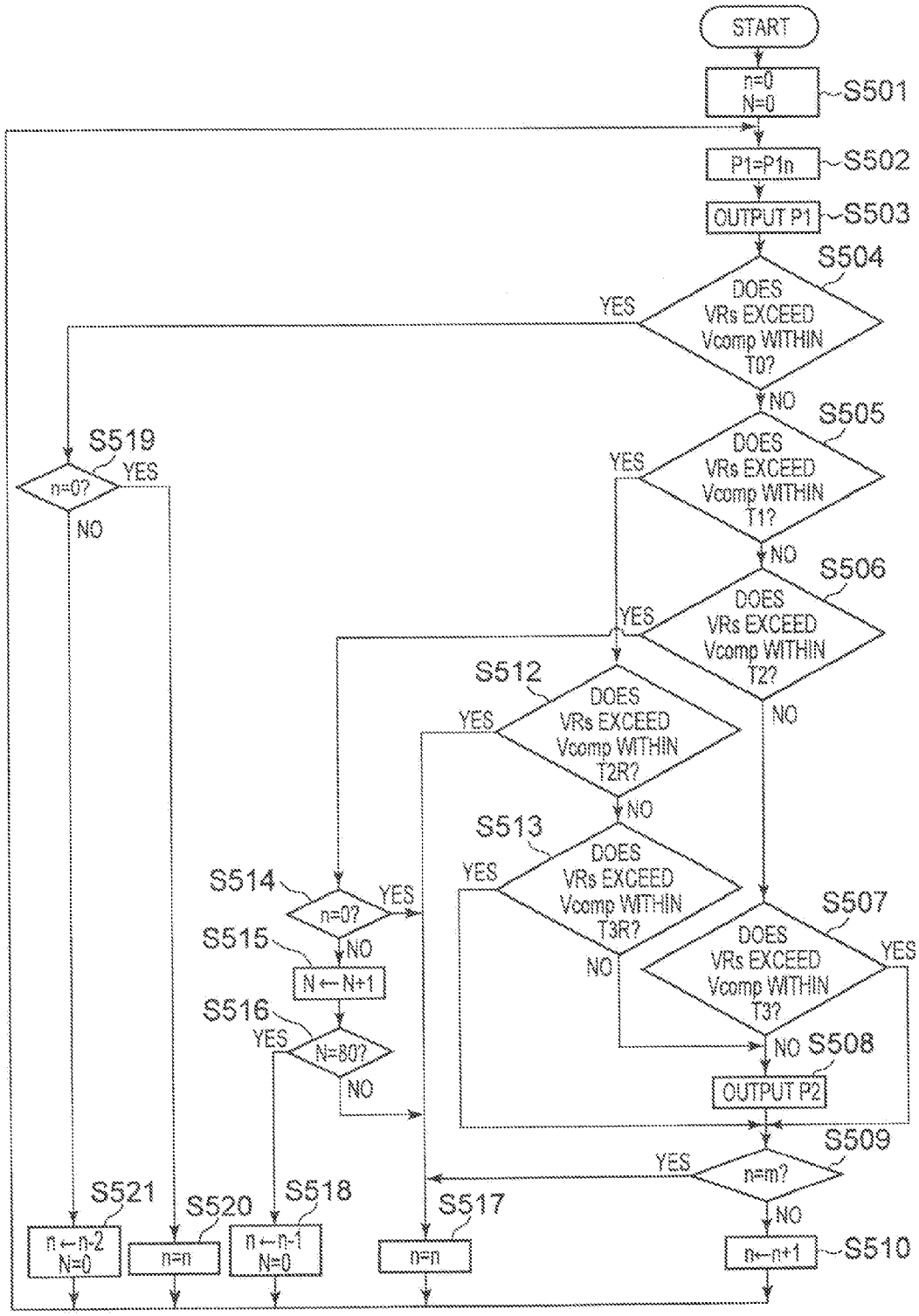
FIG. 12 is a flowchart showing an action in the fifth embodiment of the invention.

FIG. 10 is a determination flowchart common to the fourth and the fifth embodiments of the invention. FIG. 11 is a flowchart showing an action according to the fourth embodiment of the invention, and FIG. 12 is a flowchart showing an action in the fifth embodiment of the invention. In the respective drawings, the same components as those in the respective embodiments are designated by the same reference numerals.

The fourth and the fifth embodiments of the invention are the same as the respective embodiments described, above regarding FIG. 1, FIG. 2, FIG. 5, and FIG. 6, and are the same as the respective embodiments described above in behavior of rotation, detection timing of the induced signal VRs, and configurations of the respective time intervals T0 to T3 which constitute the detection time interval T regarding FIG. 3, but are different in pulse control action, as described later.

In other words, in FIG. 10, when (1, 1/0, 1/0, 1/0) is obtained as a pattern, indicating the condition, of rotation by the operation allowance determination circuit 111, the control circuit 103 determines that the allowance of drive energy is extremely large, and controls the pulse to degrade (pulse down) the drive energy of the main drive pulse P1 by a predetermined first rank (two ranks in the fourth and the fifth embodiments) so as to change the pulse to a main drive pulse P1 which is the first rank lower every time when the corresponding pattern is obtained.

Also, when a pattern (0, 0, 1, 1/0) is obtained, she control circuit 103 determines that the allowance of drive energy is large, and controls the pulse to degrade (pulse down; the drive energy of the main drive pulse P1 to a second rank smaller than the first rank (one rank in the fourth and the fifth embodiments) so as to change the pulse to a main drive pulse P1 which is the second two rank lower every time when the pattern is obtained continuously by a predetermined number of times (80 times in the fourth and the fifth embodiments).

Description of the fourth embodiment of the invention will be given with reference to FIG. 1, FIG. 2, FIG. 5, FIG. 6, FIG. 10, and FIG. 11. The oscillation circuit 101 generates a reference clock signal of a predetermined frequency, and the frequency divider circuit 102 divides the frequency of the signal generated by the oscillation circuit 101 and generates a time signal as a reference of time counting, and outputs the same to the control circuit 103.

The control circuit 103 counts the time signal and performs a time counting action. Then, the control circuit 103 firstly sets en energy rank n of a main drive pulse Pin and a counted number N indicating the number of times of the continuous driving by the same main drive pulse P1 to zero Step S501 in FIG. 11), and then outputs a main drive pulse control signal to rotationally drive the stepping motor 108 with a main drive pulse P10 with a minimum pulse width (Steps S502 and 3503).

The main drive pulse generating circuit 104 outputs the main drive pulse P10 corresponding to the control signal to the motor driver circuit 107 in response to the control signal from the control circuit 103. The motor driver circuit 107 rotationally drives the stepping motor 108 by the main drive pulse P10. The stepping motor 108 is rotationally driven by the main drive pulse P10 and rotationally drives the time-of-day hands of the analogue display unit 109. Accordingly, when the stepping motor 108 is normally rotated, the current time-of-day display by the time-of-day hands is achieved by the analogue display unit 109.

The control circuit 103 performs determination whether or not the rotation detection circuit 110 detects the induced signal VRs of the stepping motor 108 exceeding the predetermined reference threshold voltage Vcomp, and whether or not the operation allowance determination circuit 111 determines that a detected time t of the induced signal VRs fails within the time interval T0 (that is, determination whether or not the induced signal VRs exceeding the reference threshold voltage Vcomp is detected within the first time interval T0) (Step S503).

If the control circuit 103 determines that the induced signal VRs exceeding the reference threshold voltage Vcomp is not detected within the time interval T0 in the process step S504 (it is a case of the pattern (0, -, -, -)), whether or not the induced signal VRs exceeding the reference threshold voltage Vcomp is detected within the time interval T1 is determined (Step S505).

If the control circuit 103 determines that the induced signal VRs exceeding the reference threshold voltage Vcomp is not detected within the time interval T1 in the process step S505 (it is a case of the pattern (0, 0, -, -)), whether or not the induced signal VRs exceeding the reference threshold voltage Vcomp is detected within the time interval. T2 is determined (Step S506).

If the control circuit 103 determines that, the induced signal VRs exceeding the reference threshold voltage Vcomp is not detected within the time interval T2 in the process step S506 (it is a case of the pattern (0, 0, 0, -)), whether or not the induced signal VRs exceeding the reference threshold voltage Vcomp is detected within the time interval T3 is determined (Step S507).

If the control circuit 103 determines that the induced signal VRs exceeding the reference threshold voltage Vcomp is not detected within the time interval T3 in the process step S507 (it is a case of a pattern (0, 0, 0, 0), and the case of non-rotation with extremely large load increment in FIG. 10), the stepping motor 108 is controlled to be driven by the corrected drive pulse P2 having the same polarity as the main drive pulse P1 in the process step 2101 (Step S508).

Subsequently, if the rank n of the corresponding main drive pulse P1 is not the highest rank m, the control circuit 103 upgrades the main drive pulse P1 by one rank to a main drive pulse P1 (n+1). Then, the procedure goes back to the process step S502, and the main drive pulse P1 (n+1) is used for the next driving (Steps S509 and S510).

If the rank n of the corresponding main drive pulse P1 is the highest rank m in the process step S509, the control circuit 103 degrades the main drive pulse P1 by one rank to a main drive pulse P1 (n−a) having a smaller energy by a predetermined amount. Then, the procedure goes back to the process step S502 (Step S511), and the main drive pulse P1 (n−a) is used for the next driving.

In this case, since the rotation is not possible even with the drive pulse P1max, which is the drive pulse having the maximum energy rank m in the main drive pulse P1, waste of energy caused by driving with the main drive pulse P1max having the maximum energy rank m for the next driving is reduced. At this time, the main drive pulse may be changed to the main, drive pulse P10 having the minimum energy in order to achieve a high power-saving effect.

If the control circuit 103 determines that the induced signal VRs exceeding the reference threshold voltage Vcomp is detected within the time interval T2 in the process step S507 (it is a case of a pattern (0, 0, 0, 1), and the case of rotation with least reserve capacity with large load increment in FIG. 10)), the procedure goes to the process step S509 without performing driving by the corrected drive pulse P2.

If the control circuit 103 determines that the induced signal VRs exceeding the reference threshold voltage Vcomp is defected within the time interval T2 in the process step S506 (it is a case of a pattern (0, 0, 1, -)), whether or not the main, drive pulse P1 is the minimum rank 0 is determined (Step S514).

If the control circuit 103 determines that the rank, n of the main drive pulse P1 is not the lowest, rank 0 in the process step S514, the counted number N indicating the number of times of continuous driving is incremented by one (Step S515), and whether or not the counted number K reaches a predetermined second number of times (80 times in this embodiment) is determined (Step S516).

If the control circuit 103 determines that the predetermined second number of times is not reached; the procedure goes back to the process step S502 without changing the rank of the main drive pulse P1 (Step 517), and if the predetermined second number of times is reached, the rank of the main drive pulse P1 is degraded by the predetermined second rank (one rank in this embodiment), the counted value N is reset to "0", and the procedure goes back to the process step S502 (Step S518). In this manner, the main, drive pulse P1 is degraded by the predetermined second rank every time when the condition, in which the energy of the main drive pulse P1 has a predetermined allowance (predetermined pattern) occurs continuously by the predetermined second number of times.

If the control circuit 103 determines that the rank n of the main drive pulse P1 is the lowest rank 0 in the process step S514, the procedure goes to the process step S517, and goes back to the process step S502 without changing the rank n of the main drive pulse P1.

If the control circuit 103 determines that the induced signal VRs exceeding the reference threshold voltage Vcomp is detected within the time interval T1 in the process step S505 (it is a case of the pattern (0, 1, -, -)), whether or not the induced signal VRs exceeding the reference threshold voltage Vcomp is detected within the time interval T2 is determined (Step S512).

If the control circuit 103 determines that the induced signal VRs exceeding the reference threshold voltage Vcomp is not detected within the rime interval T2 in the process step S512 (it is a case of a pattern (0, 1, 0, -)), whether or not the induced signal. VRs exceeding the reference threshold voltage Vcomp is detected within the time interval T3 is determined (Step S513).

If the control circuit 103 determines that the induced signal VRs exceeding the reference threshold voltage Vcomp is not detected within the time interval T2 in the process step S513 (it is a case of a pattern (0, 1, 0, 0), and the case of non-rotation with extremely large load increment in FIG. 10), the procedure goes to the process step S508.

If the control circuit 103 determines that the induced signal VRs exceeding the reference threshold voltage Vcomp is detected within the time interval 13 in the process step S513 (it is a case of a pattern (0, 1, 0, 1)), and the case of rotation with least reserve capacity with large load increment in FIG. 10)), the procedure goes to the process step S509.

If the control, circuit 103 determines that the induced signal VRs exceeding the reference threshold voltage Vcomp is detected within the time interval T2 in the process step S512 (it is a case of a pattern (0, 1, 1, -)), the procedure goes to the process step S517.

In contrast, if the control circuit 103 determines that the induced signal VRs exceeding the reference threshold voltage Vcomp is detected within the time interval T0 in the process step S504 (it is a case of a pattern (1, -, -, -) and is a case of an extremely large reserve driving capacity), whether or not the main drive pulse P1 is the minimum rank 0 is determined (Step S519).

If the control circuit 103 determines that she rank n of the main, drive pulse P1 is not the lowest rank 0 in the process step S519, the control circuit 103 degrades she rank of the main drive pulse P1 by the predetermined first rank (a plurality of ranks in this embodiment and, for example, two ranks), and resets she counted value N to zero, and the procedure goes hack to the process step S502 (Step S521).

If the control circuit 103 determines that the rank n of the main drive pulse P1 is the lowest rank 0 in the process step S519, the rank n of the main drive pulse P1 is not changed, and the procedure gees back to the process step S502 (Step S520).

Accordingly, the control circuit 103 degrades the main drive pulse P1 by the predetermined first rank every time when the condition having a predetermined sufficient reserve capacity of energy of the main drive pulse P1 (predetermined pattern, (1, 0, 0, 0) in this embodiment) occurs by the predetermined first number of times which, is smaller than the second number of times (once in this embodiment). Here, the first rank is set to be larger than the second rank.

In this manner, the stepping motor control circuit according to the fourth embodiment of the invention is characterized in that the control unit degrades the main drive pulse P1 when the rotation detection, unit detects the induced signal VRs exceeding the reference threshold voltage continuously by the first number of times in the first time interval T0, and degrades the main drive pulse P1 when the rotation detection unit detects the predetermined pattern continuously by the second number of times when the induced signal VRs exceeding the reference threshold voltage Vcomp is not detected in the first time interval T0, and the first number of times is smaller number of times than the second number of times.

Here, the control unit may be configured to degrade the main drive pulse P1 by the first rank when the rotation detection unit detects the induced signal VRs exceeding the reference threshold voltage Vcomp continuously by the first number of times in the first time interval T0 and degrade the main drive pulse by the second rank when the predetermined pattern is detected continuously by the second number of times when the induced signal VRs exceeding the reference threshold voltage Vcomp is not detected in the first time interval T0, in which the first rank is larger than the second rank.

The first number of times may be one time.

The first rank may be configured to be two ranks and the second rank may be configured to be one rank.

Therefore, the fourth embodiment of the invention achieves not only the same advantages as in the first embodiment, but also advantages that the main drive pulse P1 may be degraded to a minimum main drive pulse P1 which can drive the stepping motor 108 in a short period even when the rank of the main drive pulse P1 is raised to the maximum due to a calendar load or a magnetic field load because the time period until the pulse down is performed is changed depending on the drive energy allowance, so that wasted power consumption may be reduced.

Since there is only one counter, the configuration is simple, and hence decrease in size is possible when it is made integrated, configuration.

Since the energy of the drive pulse P1 may be reduced every second or the main drive pulse P1 may be reached the minimum drive pulse in a short period by determining the state of drive allowance of the main drive pulse P1, waste of power may be inhibited.

According to the movement of the fourth embodiment of the invention, an analogue electronic timepiece achieving the above-described advantages may be constructed.

According to the analogue electronic timepiece of the fourth embodiment of the invention, the above-described advantages are achieved. Therefore, accurate movement of hands is achieved and battery life may be elongated.

FIG. 12 is a flowchart showing a process according to a fifth embodiment of the invention, and the fifth embodiment is the sane as the fourth embodiment regarding FIG. 1, FIG. 2, FIG. 5, FIG. 6, and FIG. 10.

Although the main drive pulse P1 is configured to be changed to a main drive pulse P1 (n−a) having a predetermined small energy when the rank n of the main drive pulse P1 is the highest rank m in the process step S509 in FIG. 11 in the fourth embodiment (Step S511), the main drive pulse P1 is configured not to be changed when the rank n of the main drive pulse P1 is the highest rank m in the process step S509 in the fifth embodiment (Step S517). Other processes are the same as those in the fourth embodiment. Since the fifth embodiment is configured as described above, the same advantages as in the fourth embodiment are obtained.

The stepping motor control circuit according to the respective embodiments of the invention may be applied to the stepping motor configured to drive members other than the time-of-day hands or the calendars.

Also, although the electronic timepiece has been described as the example of the application of the stepping motor, it may be applied to electronic instruments which use the motor.

INDUSTRIAL APPLICABILITY

The stepping motor control circuit according to the invention may be applicable to various electronic instruments using the stepping motor.

The movement and the analogue electronic timepiece according to the invention may be applied to various analogue electronic timepieces including various types of analogue electronic timepieces with a calendar function such as analogue electronic watches with a calendar functions or analogue electronic standing clocks with a calendar function.

What is claimed is:

1. A stepping motor control circuit comprising:

a rotation detection unit configured to detect the condition of rotation of a stepping motor on the basis of an induced signal generated in a drive coil of the stepping motor in a detection period in which the condition of rotation of the stepping motor is detected; and a control unit configured to rotationally drive the stepping motor by supplying a drive signal to the drive coil of the stepping motor in a driving period in which the stepping motor is rotationally driven, wherein the drive period and part of the detection period are configured to overlap in a first time interval, and the control unit stops supply of the drive signal to the drive coil of the stepping motor in the first time interval within the driving period.

2. The stepping motor control circuit according to claim 1, wherein the main drive pulse is a comb-shaped main drive pulse in which a supply state in which the drive signal is supplied and a supply stop state in which the supply of the drive signal is stopped are repeated alternately at a predetermined cycle in the drive period, and the rotation detection unit detects the induced signal in the supply stop period in the first tree interval.

3. The stepping motor control circuit according to claim 1, wherein the main drive pulse is a waveform drive pulse obtained by eliminating the first time interval from a square-wave drive pulse continuing for the drive period.

4. The stepping motor control circuit according to claim 1, wherein the detection period is divided into a plurality of time intervals including the first time interval and at least one time interval provided after the first time interval, and the rotation detection unit detects the condition of rotation of the stepping motor on the basis of a pattern of the induced signal exceeding the reference threshold voltage generated in the plurality of time intervals.

5. The stepping motor control circuit according to claim 2, wherein the detection period is divided into a plurality of time intervals including the first time interval and at least one time interval provided after the first time interval, and the rotation detection unit detects the condition of rotation of the stepping motor on the basis of a pattern of the induced signal exceeding the reference threshold voltage generated in the plurality of time intervals.

6. The stepping motor control circuit according to claim 3, wherein the detection period is divided into a plurality of time intervals including the first time interval and at least one time interval provided after the first time interval, and the rotation detection unit detects the condition of rotation of the stepping motor on the basis of a pattern of the induced signal exceeding the reference threshold voltage generated in the plurality of time intervals.

7. The stepping motor control circuit according to claim 1, wherein the stepping motor includes a rotor, and a stator having a rotor housing through hole configured to house the rotor so as to be rotatable and a positioning notched portion provided integrally with the rotor housing through hole and configured to determine the stable still position of the rotor, and the first time interval is a time interval in which the condition of rotation between the positioning notched portion and the horizontal magnetic pole of the stator is detected.

8. The stepping motor control circuit according to claim 2, wherein the stepping motor includes a rotor, and a stator having a rotor housing through hole configured to house the rotor so as to be rotatable and a positioning notched portion provided integrally with the rotor housing through hole and configured to determine the stable still position of the rotor, and the first time interval is a time interval in which the condition of rotation between the positioning notched portion and the horizontal magnetic pole of the stator is detected.

9. The stepping motor control circuit according to claim 3, wherein the stepping motor includes a rotor, and a stator having a rotor housing through hole configured to house the rotor so as to be rotatable and a positioning notched portion provided integrally with the rotor housing through hole and configured to determine the stable still position of the rotor, and the first time interval is a time interval in which the condition of rotation between the positioning notched portion and the horizontal magnetic pole of the stator is detected.

10. The stepping motor control circuit according to claim 4, wherein the stepping motor includes a rotor, and a stator having a rotor housing through hole configured to house the rotor so as to be rotatable and a positioning notched portion provided integrally with the rotor housing through hole and configured to determine the stable still position of the rotor, and the first time interval is a time interval in which the condition of rotation between the positioning notched portion and the horizontal magnetic pole of the stator is detected.

11. The stepping motor control circuit according to claim 5, wherein the stepping motor includes a rotor, and a stator having a rotor housing through hole configured to house the rotor so as to be rotatable and a positioning notched portion provided integrally with the rotor housing through hole and configured to determine the stable still position of the rotor, and the first time interval is a time interval in which the condition of rotation between the positioning notched portion and the horizontal magnetic pole of the stator is detected.

12. The stepping motor control circuit according to claim 6, wherein the stepping motor includes a rotor, and a stator having a rotor housing through hole configured to house the rotor so as to be rotatable and a positioning notched portion provided integrally with the rotor housing through hole and configured to determine the stable still position of the rotor, and the first time interval is a time interval in which the condition of rotation between the positioning notched portion and the horizontal magnetic pole of the stator is detected.

13. The stepping motor control circuit according to claim 1, wherein the drive signal includes a plurality of types of the main drive pulses having energies different from each other, and the control unit driven with the degraded main drive pulse when the rotation detection unit ceteris the induced signal exceeding a predetermined reference threshold voltage in the first time interval.

14. The stepping motor control circuit according so claim 13, wherein the detection period includes the first time interval, a second time interval continuing after the first time interval, a third time interval continuing after the second time interval, and a fourth time interval continuing after the third time interval, and the control unit degrades the main drive pulse when she rotation detection unit detects the induced signal exceeding the reference threshold voltage in the first time interval and performs pulse control on the basis of the pastern of the induced signal exceeding the reference threshold voltage in the second time interval to the fourth time interval when the induced signal exceeding the reference threshold voltage is not detected in the first time interval.

15. The stepping motor control circuit according to claim 14, wherein the control unit degrades the main drive pulse when the rotation detection unit detects the induces signal exceeding the reference threshold voltage continuously by a first number of times in the first time interval, and degrades the main drive pulse when the rotation detection unit detects the predetermined pattern continuously by a second number of times when the induced signal exceeding the reference threshold voltage is not detected in the first time interval, and the first number of times is smaller number of times than the second number of times.

16. The stepping motor control circuit according to claim 14, wherein the control unit degrades the main drive pulse by s first rank when the rotation detection unit detects the induced signal exceeding the reference threshold voltage continuously by the first number of times in the first time interval and degrades the main drive pulse by s second rank when the predetermined pattern is detected continuously by the second number of times when the induced signal exceeding the reference threshold voltage is not detected in the first time interval, and the first rank is larger than the second rank.

17. The stepping motor control circuit according to claim 15, wherein the first cooler of times is one time.

18. The stepping motor control circuit according to claim 16, wherein the first rank is two ranks and the second rank is one rank.

19. A movement comprising the stepping motor control circuit according to claim 1.

20. An analogue electronic timepiece comprising the movement according to claim 19.

* * * * *